US005452205A

United States Patent [19]

Telepko

[11] Patent Number: 5,452,205

[45] **Date of Patent: * Sep. 19, 1995**

[54] UNIVERSAL CONTROLLER FOR CONTINUOUS PASSIVE MOTION DEVICES

[75] Inventor: George Telepko, Fort Washington, Pa.

[73] Assignee: Jace Systems, Inc., Moorestown, N.J.

[ * ] Notice: The portion of the term of this patent subsequent to Oct. 19, 2010 has been disclaimed.

[21] Appl. No.: 130,567

[22] Filed: Oct. 1, 1993

Related U.S. Application Data

[63] Continuation-in-part of Ser. No. 760,424, Sep. 16, 1991, Pat. No. 5,255,188.

[51] Int. Cl.[6] ..... A61H 1/00

[52] U.S. Cl. ..... 364/413.27; 601/5; 601/84

[58] Field of Search ..... 364/413.27, 413.02, 364/550, 413.01, 506, 508, 511, 565, 551.01; 73/379.01; 128/25 R, 24.2, 25 B; 601/23, 26, 5, 84, 87, 93, 101

[56] References Cited

U.S. PATENT DOCUMENTS

| | | | |
|---|---|---|---|
| 2,250,493 | 7/1941 | Milne . | |
| 2,255,066 | 9/1941 | Lamb . | |
| 2,397,428 | 3/1946 | Moshier . | |
| 4,276,887 | 7/1981 | Hofstein . | |
| 4,487,199 | 12/1984 | Saringer | 128/25 R |
| 4,520,827 | 6/1985 | Wright et al. | 128/423 W |
| 4,558,692 | 12/1985 | Greiner | 128/25 R |
| 4,601,468 | 7/1986 | Bond et al. | 272/130 |
| 4,621,620 | 11/1986 | Anderson | 128/25 R |
| 4,628,909 | 12/1986 | Tietsworth | 128/25 R |
| 4,637,379 | 1/1987 | Saringer | 128/25 R |
| 4,665,899 | 5/1987 | Farris et al. . | |
| 4,671,257 | 6/1987 | Kaiser et al. | 128/25 R |
| 4,716,889 | 1/1988 | Saringer | 128/25 R |
| 4,798,197 | 1/1989 | Nippoldt et al. | 128/25 R |
| 4,862,875 | 9/1989 | Heaton . | |
| 4,930,497 | 6/1990 | Saringer | 128/25 R |
| 5,039,093 | 8/1991 | Collier . | |
| 5,046,487 | 9/1991 | Scott . | |
| 5,094,226 | 3/1992 | Medcalf et al. . | |
| 5,129,873 | 7/1992 | Henderson et al. . | |
| 5,186,695 | 2/1993 | Mangseth et al. | 364/413.02 |
| 5,255,188 | 10/1993 | Telepko | 364/413.27 |

*Primary Examiner*—Ellis B. Ramirez
*Assistant Examiner*—Edward Pipala
*Attorney, Agent, or Firm*—Panitch Schwarze Jacobs & Nadel

[57] ABSTRACT

A universal controller for controlling a plurality of types of continuous passive motion (CPM) devices includes a control panel. Input keys are located within the control panel and provide input parameters which define the limits of operation and modes of operation for a particular CPM device. A microprocessor processes the received input parameters and controls the operation of the particular type of CPM device. Sensors located within the CPM device determine the instantaneous state of the particular CPM device and determine the specific type of CPM device. CPM operating parameters associated with the particular CPM device are stored within a data retention area of the microprocessor. A timer determines time measurements for time dependent calculations.

29 Claims, 15 Drawing Sheets

J1
J2
FLEX NMES
PLY 1
EXTN NMES
PLY 2
EXT
FLX
STOP/GO
PSE
TIM
FRC
TOUCH PAD KEY SWITCH
40
UP
DN
SPD
+12V
Q1
Q2
P2
P3
P4
D7 D6 D5 D4 D3 D2 D1 D0 E RW RS VDD VL VSS EL1 EL2
X1
XTAL 2
+5V
A6 A7 A3 A4 A5 C0 C1 C2 C3 C4 C5 C6 C4 INT2 ANO ANI AN2 AN4 AN3 Vcc3 Vcc3 B7 B6 B5 B4 B3 B2 B1 B0 D2 D1 D0 XTAL1 RESET AN5 AN6
50
U4
U3
U2
MOTOR
PWM
DIR
TYPE 2
TYPE 1
TYPE 0
TACH
ANGLE
IMON
A GRD
+12V
GRD
SPARE 1
SPARE 2
KEY
SHIELD

CPM MACRO-FLOW CHART

UNIVERSAL CONTROLLER FOR CONTINUOUS PASSIVE MOTION DEVICES

This application is a continuation-in-part of Universal Controller for Continuous Passive Motion Devices, U.S. patent application Ser. No. 07/760,424, filed Sep. 16, 1991, now U.S. Pat. No. 5,255,188.

BACKGROUND OF THE INVENTION

The present invention relates generally to controllers and, more particularly, to a controller for a passive motion device.

Continuous passive motion (CPM) orthosis devices provide an important rehabilitative treatment used by many doctors and therapists for the treatment of injuries or as part of a postoperative recovery plan. Continuous passive motion devices are typically motor driven and are designed to exercise a particular joint by repeatedly extending and flexing the joint. The devices are capable of applying continuous motion to the joint in a consistent manner and can be adjusted to operate at different speeds and within a defined range of motion affecting the joint.

A continuous passive motion device is typically associated with a controller which determines the parameters by which the device operates. The parameters can include the speed at which the device motor runs, the range of motion, the forces on the patient and any other suitable parameters. Many prior art controllers are only capable of operating a specific type of orthosis device, such as an anatomically correct knee CPM orthosis device.

Thus, there was a need for a universal CPM controller which is compatible with different types of orthosis devices; e.g. hand, toe, non-anatomically correct knee devices based upon a plurality of input parameters relating to a particular orthosis CPM device which are inputted into the universal controller. The parameters relate to the speed at which extension and flexion occur, the angular velocity at which a specified pivot point corresponding to the joint to be exercised is translated, and the force experienced by the joint during the course of motion. The parameters are entered on a keypad by a therapist or the patient. Other parameters that are specific to the particular orthosis CPM device, such as the physical capability of the device, the drive geometry, the motor power to the force relationship, the motor speed to angular velocity, and the type of device are entered in the form of a binary code which is received by the controller and used to retrieve information from a software look-up table to determine the type of CPM orthosis device to be controlled. The controller operates the particular orthosis device according to the specified parameters and is capable of detecting and diagnosing faults which occur during the operation of the device.

A universal CPM controller of this type is taught in Universal Controller for a Continuous Passive Motion Devices filed on Sep. 16, 1991 by Telepko of which this application is a continuation-in-part. The controller taught by Telepko could control a plurality of different types of orthosis devices. This control included control of the speed of the extension and flexion of the orthosis devices. However, the device taught by Telepko, as well as the other known controller devices, merely starting flexing and extending the joints of the user even though movement, especially movement corresponding to the full programmed range, may be painful to the patient.

Therefore, there is a need for a universal CPM controller which is effective to gradually advance the patient to the full range and speed of the program. Additionally, there is a need for a universal CPM controller which is capable of providing tensioning to the joints of the user when immediate flexion and extension are not appropriate.

SUMMARY OF THE INVENTION

Briefly stated, the present invention comprises a universal controller for controlling a plurality of types of continuous passive motion (CPM) devices. The universal controller comprises a control panel. Input means are located within the control panel and provide input parameters which define the limits of operation and modes of operation for a particular CPM device. Microprocessing means process the received input parameters and control the operation of the particular type of CPM device. Sensing means are provided for determining the instantaneous state of the particular CPM device and for determining the specific type of CPM device. Data retention means are located within the microprocessing means for retention of the CPM operating parameters. Time measuring means determine time measurements for time dependent calculations. The universal controller further comprises means for automatically determining the specific type of CPM device.

BRIEF DESCRIPTION OF THE DRAWINGS

The foregoing summary, as well as the following detailed description of a preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DETAILED DESCRIPTION OF PREFERRED EMBODIMENTS

Figure 1A:
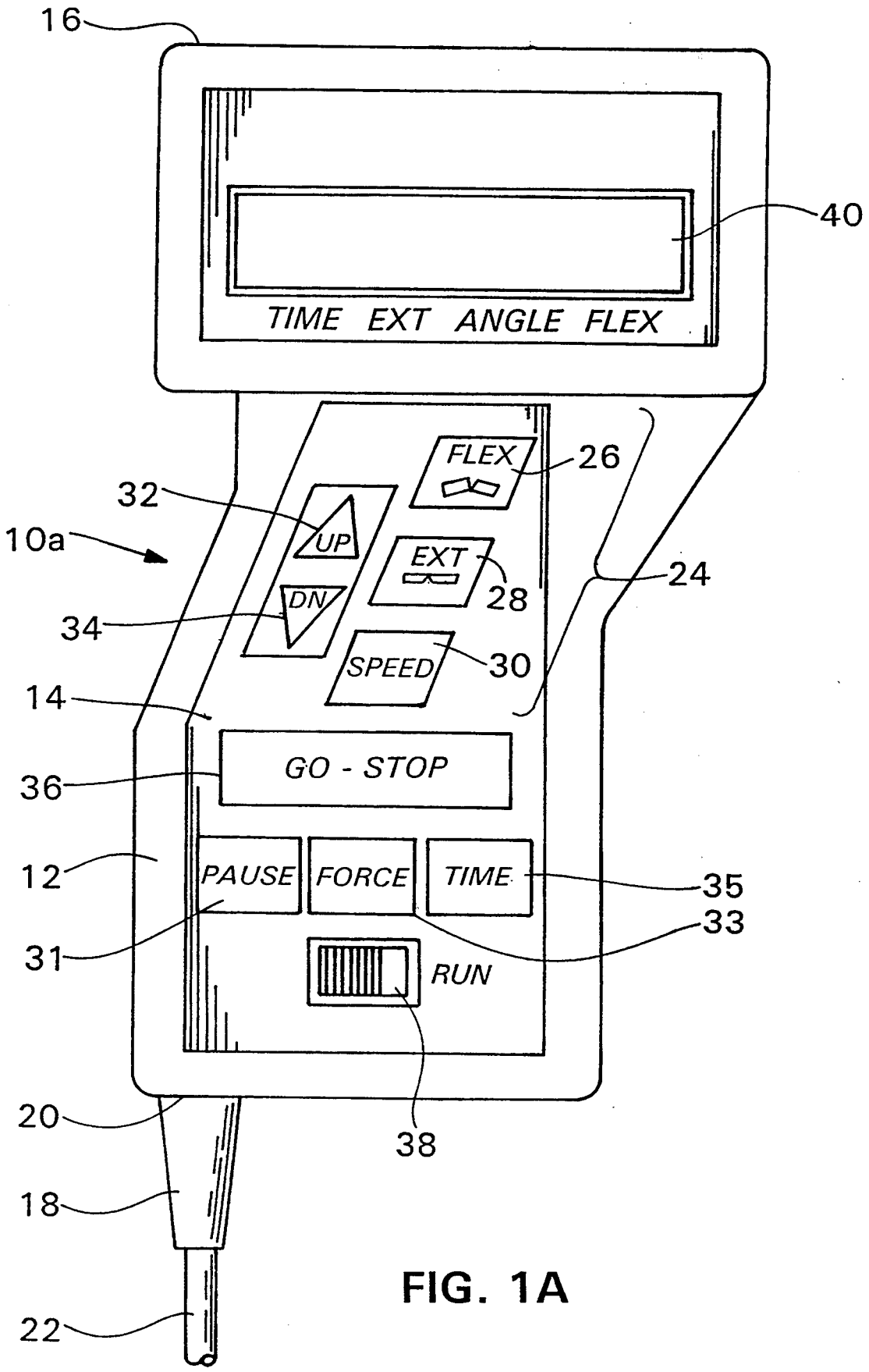
FIG. 1A is a plan view of a CPM controller in accordance with the present invention.

Referring to the drawings, like numerals are used to indicate like elements throughout, there is shown in FIG. 1A a perspective view of a universal controller **10*a* for controlling a plurality of types of continuous passive motion devices in accordance with the present invention. The universal controller 10*a* is contained within a housing 12 having a front panel 14, a first end 16, and a second end 18. It is to be understood by those skilled in the art that the controller 10*a* can be a separate hand-held unit or incorporated into the CPM device. Located at the second end 18 of the housing 12 is a terminal 20 for receiving a first end of a cable 22. The second end of the cable 22** (not shown) is connected to a remotely located CPM device (not shown).

The front panel 14 of the controller 10*a* includes input means in the form of a plurality of input keys 24 for providing parameters which define the limits of operation and modes of operation for a particular CPM device (not shown) as will be discussed in detail hereinafter. The parameters which are inputted to the controller 10*a* include, but are not limited to the following: the angular limits of desired motion, the angular velocity of a specified pivot point associated with a joint to be exercised, the force at which a limb connected to the joint being exercised is raised and lowered and the pause periods at the limits of motion. The input keys 24 are preferably touch pad keys, however, any suitable type of key or switch can be used without departing from the scope and spirit of the invention.

A flexion key 26 controls the range of motion of a particular CPM device during a flexion or contraction mode of the CPM device. An extension key 28 controls the range of motion of a particular CPM device during the extension or relaxation mode. A speed key 30 controls the angular velocity at which a particular pivot point located on the particular CPM device travels. Typically, the pivot point is associated with a particular joint, such as a knee or toe which is to be exercised. In the preferred embodiment of the controller 10*a*, the pivot point controls the speed and degree of movement of the particular joint which is to be exercised. An up key 32 allows a user to increase the amount of any specified parameter. A down key 34 allows the user to decrease the amount of any specified parameter. A go/stop key 36 controls when a particular CPM device is in operation. The go/stop key 36 can also be selectively actuated to discontinue operation of the CPM device at any specified time.

A set/run slide switch 38 is used to place the controller 10*a* in a set mode or a run mode. Controller 10*b* is placed in the set mode by stopping the unit with the go/top key 36 and selecting a parameter by use of the keys 41, 43. During the set mode, all parameters relating to the CPM device may be modified within predetermined limits determined by a software table within the microprocessor (see FIG. 2) of the controller 10*a* as will be described in detail hereinafter by using the up key 32 or the down key 34. During the run mode, only the speed parameter may be increased or decreased within predetermined limits by use of the up key 32 or the down key 34. An LCD digital display 40 displays the values of each parameter and fault detection messages as will be described in detail hereinafter.

A force key 33 in conjunction with the extension key 28 or the flexion key 26 allows a user to input the maximum amount of force or force limit to be experienced by the patient's limb during the respective operation of the CPM device. A pause key 31 allows a user to set pause period at the respective limit of motion and works in conjunction with the flexion key 26 or extension key 28 is running. A time key 35 allows a user to reset or display the accumulated amount of running time which indicates the total exercise dose.

Figure 1B:
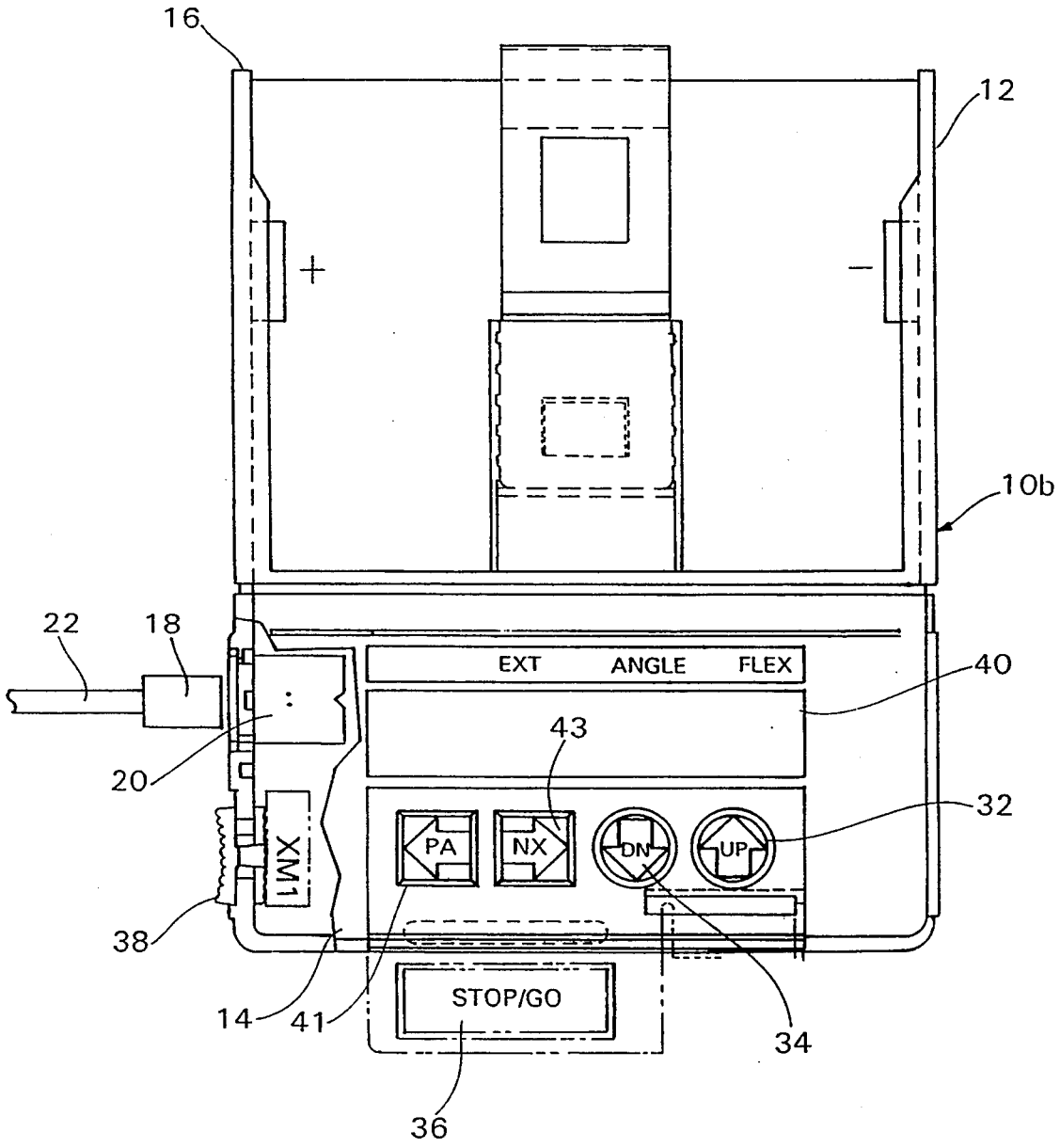
FIG. 1B is a plan view of an alternate embodiment of the CPM controller of FIG. 1A.
Figure 1C:
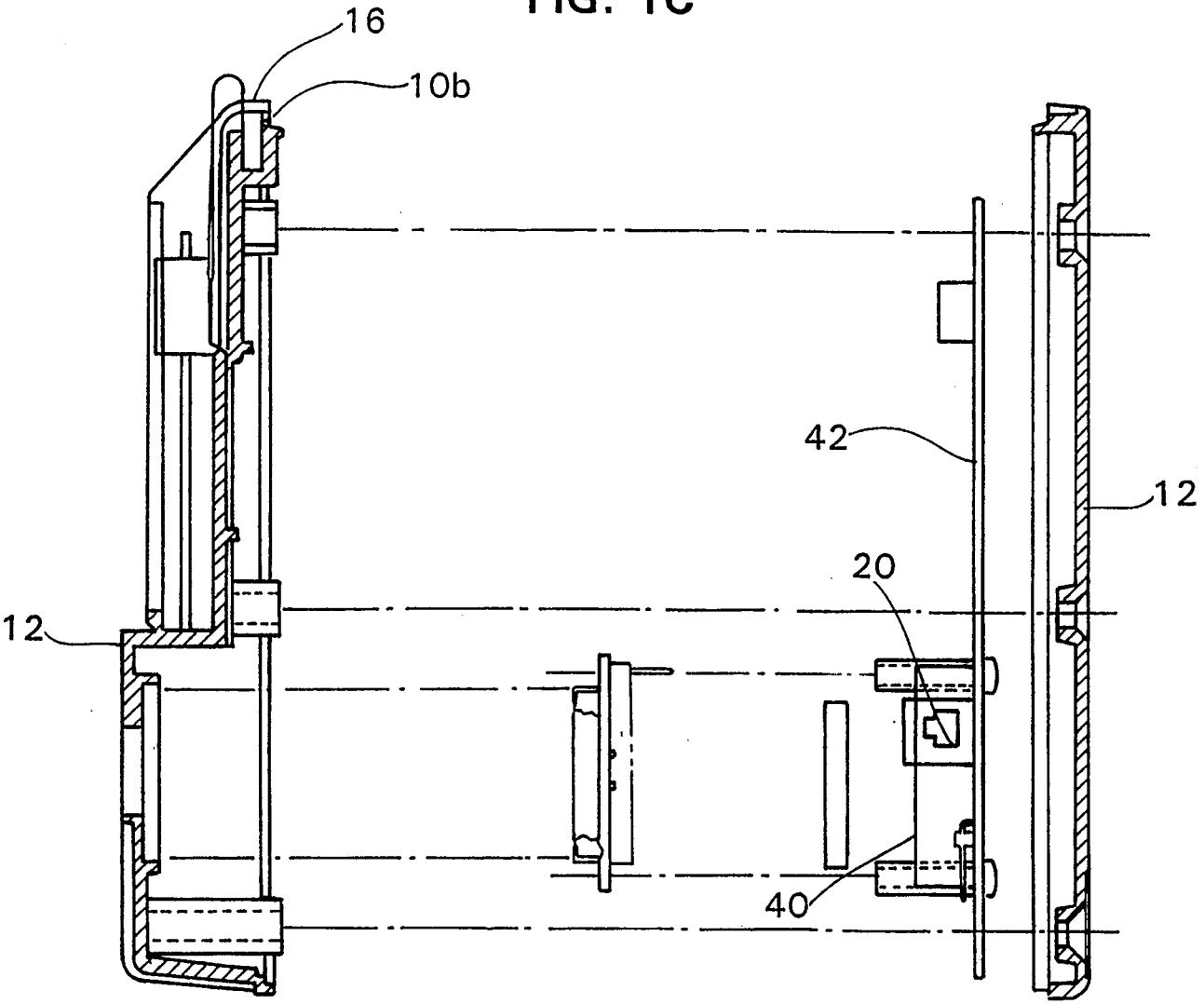
FIG. 1C is an exploded side view of the alternate embodiment shown in FIG. 1B.

Referring specifically to FIGS. 1B,C, there is shown, respectively, a plan view and an exploded side view of the CPM controller 10*b*. The CPM controller 10*b* is an alternate preferred embodiment of the CPM controller 10*a* which may be substituted for the CPM controller 10*a* to perform all of the functions described herein for the CPM controller 10*a*.

The alternate embodiment CPM controller 10*b* is provided with a previous parameter selection input key 41 and a next parameter selection input key 43. Parameter selection input keys 41, 43 permit a user to step in the forward and reverse directions through a sequence of parameters in order to select a parameter from the sequence of parameters, display the selected parameter on the display 40, and enter or modify the selected parameter using the up/down keys 32, 34. The parameter selection input keys 41, 43 of the CPM controller 10*b* may thus replace, for example, the input keys 26, 28, 30, 31, 33 and 35 of the controller 10*a*.

The parameter selection input keys 41, 43 permit an open ended extension of the number of parameters which may be modified using the controller 10*b* because there is no need for an individual input key for each parameter. Any further parameters which may be added to the sequence of parameters can be selected using the parameter selection keys 43, 41 in the same manner as the parameters previously set forth herein.

It will be understood that the reading and servicing of the parameter selection input keys 41, 43 differ from the reading and servicing of the individual input keys 24 of controller 10*a* which are replaced by the input keys 41, 43 of controller 10*b*. However, the methods for reading the input keys 41, 43 and advancing through the list of parameters are well-known to those skilled in the art. The operations for modifying parameters selected from the sequence of parameters in this manner in response to the input keys 41, 43 are substantially the same as the operations performed in response to the individual the input keys 24 of controller 10*a*.

When a selected parameter from the sequence of parameters is displayed on the display 40 of the controller 10*b*, the user may use the up/down keys 32, 34 to adjust the selected parameter. Once a parameter is modified to a desired value, depressing either the previous parameter selection key 41 or the next parameter selection key 43 is effective to select another parameter for display or modification using the controller 10*b*.

Figure 2:
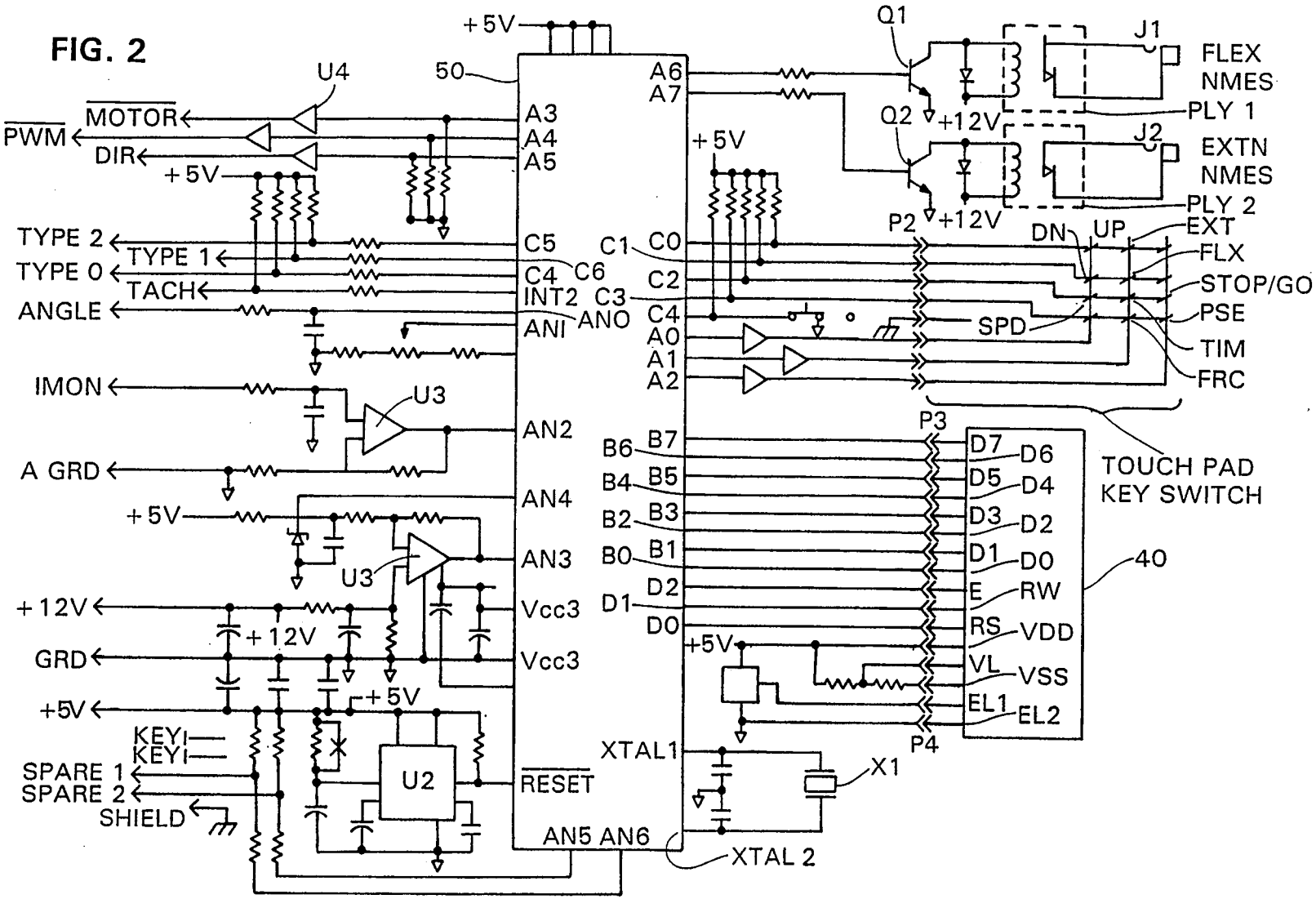
FIG. 2 is a schematic diagram of the circuitry of the CPM controller of FIG. 1.

Referring specifically to FIG. 2, there is shown a schematic diagram of the controller 10*a*. The controller 10*a* comprises microprocessing means in the form of a microprocessor 50 for processing input parameters entered into the controller 10*a* via the input keys 24 which are used to determine the limits of operation for a particular CPM device during a specific operating session. The microprocessor 50 is also responsible for controlling and monitoring the operation of the particular CPM device to determine whether the CPM device is operating within the predetermined limits defined by the microprocessor 50. In the event that faults are detected by the microprocessor 50, such as a parameter exceeding its predetermined limit, operation of the CPM device is terminated. In the preferred embodiment, the microprocessor 50 is a Texas Instruments TMS370C756 microprocessor. However, it is understood by those skilled in the art that any microprocessor can be used without departing from the scope and spirit of the present invention.

It will also be understood that the controller 10*b* is also provided with a microprocessor 50 disposed upon control printed circuit card 42. The microprocessor 50 of the controller 10*b* is programmed to perform substantially the same operations as those performed by the microprocessor 50 within the controller 10*a* except that the microprocessor 50 within the controller 10*b* is programmed to advance from one parameter to another in response to the parameter selection input keys 41, 43 rather than in response to individual function keys 24.

The microprocessor 50 within the controllers 10*a,b* includes a plurality of components which perform various pertinent functions. A read-only programmable memory (ROM) contains the CPM control program and various orthosis type tables for determining whether the various parameters for a particular CPM device are within the predetermined limits as specified by the CPM control program. A non-volatile read/-write memory (EEPROM) provides storage for the CPM operating parameters. These parameters include the range of motion for the device, the force limits and pause periods, the angular velocity of a specified pivot point located on the CPM device and the accumulated run time. A random access memory (RAM) contains operating registers and dynamic storage. The operating parameters are those real-time parameters as established during the operation of the particular CPM device. Software configurable timers control all time related functions including CPM motor functions. The CPM motor functions include pulse width modulation and speed determinations. An eight channel ratiometric analog to digital converter provides an analog sensor interface. A plurality of programmable parallel input-/output ports provide motor control. The microprocessor 50 also includes a display interface, a keypad scan interface, an orthosis type input, an external device control, programmable external interrupts for a motor tachometer interface and a watchdog timer for program execution monitoring.

Ancillary circuits associated with the microprocessor 50 provide microprocessor timing references (X1 crystal), a power ON reset (U2), a sensor signal conditioning circuit (U3), a motor driver and keypad scan driver (U4), a relay drive with relays and connectors for neuro-muscular stimulators (NMES) (Q1, Q2, RLY1, RLY2), and a liquid crystal display illumination drive (INV).

The microprocessor 50 transmits data to an alphanumeric LCD display 40 using D0–D2 control lines and B0–B7 IO data lines. The LCD display 40 displays to a user the type of orthosis device connected to the controller 10*a*, the keypad selected parameter and its numeric value, orthosis angle and set limits of motion, various diagnostic or calibration parameters, and various users prompting and fault messages. The LCD display 40 receives at input ports D0–D7 specified information such as the real time value of certain parameters which are then displayed to a user.

The microprocessors 50 within the controllers 10*a,b* also receive data from a plurality of sources (not shown). The microprocessor 50 receives data from the input keys 24 on pins C0–C4. Scanning of the input keys 24 is performed by activating output pins A0–A2 which select the keypad column lines and inputting key data on pins C0–C3. As discussed above, the run/set switch 38 selects the desired mode of controller operation. If the controller 10*a* is in the run mode as determined by the run/set switch 38 on input pin C4, the input parameters can be selected for display on the LCD display 40.

In the run mode, only the speed parameter may be modified, all other parameters must remain unchanged within the controllers 10*a,b*. If the controllers 10*a,b* are in the set mode, any of the input parameters can be selected for display. The parameters can be selected by depression of a primary function key which include the extension key 28, the flexion key 26 or the speed key 30 in controller 10*a*. Additionally, within controller 10*a*, secondary function keys are activated when both the extension key 28 and the force key are activated which selects force limits or upon activation of the extension key 28 and the pause key which selects pause. Secondary function keys also include the activation of both the flexion key 26 and the force key or the flexion key 26 and the pause key. In the controller 10*b* the parameters can be selected using parameter selection input keys 41, 43 as previously described. As discussed above, any parameter can be modified while the controllers 10*a,b* are in the set mode with the limits of orthosis type by depressing the up key 32 or the down key 34.

Output pins A6 and A7 of the microprocessor 50 control the activation of neuro-muscular stimulator (NMES) relays associated with a patient connected NMES device. The NMES relays RLY1 and RLY2 provide electrical isolation between the patient connected NMES device and the non-patient connected CPM device. The NMES device electrically simulates the patient's muscles during the pause which occurs after every flexion and extension cycle.

Output pins A3, A4 and A5 are connected directly to 10 the motor driver (not shown) of the particular CPM device. Output pin A3 transmits data for controlling the CPM motor power during operation. Output pin A4 controls the motor speed by ON/OFF pulse width modulation of the CPM motor during operation. Pulse width modulation of the motor is used to maintain the angular velocity of a specified pivot point of the CPM device. Output pin A5 controls the direction of motion of the CPM device by controlling the direction of motor rotation. A motor tachometer located on the CPM motor armature indicates the rotation of the armature. Interrupt input pin INT2 receives tachometer data relating to the actual CPM motor speed. The period of each tachometer pulse is inversely proportional to the motor speed and determines the width of the power ON pulse. The number of tachometer pulses after the power ON pulse indicate the rate of motor inertial coast or motor load, and are used to set the power OFF period. The power OFF period is calculated based on the set angular velocity, present angle and the number of tachometer pulses in the total measured power period.

The microprocessor 50 determines the CPM pivot angle at the specified pivot point associated with the joint to be exercised by performing a ratiometric A/D conversion on analog inputs AN0 and AN1. The AN1 input is the angle reference calibration input which is scaled to provide one A/D count per 0.75 degree rotation of the pivot point.

The controllers 10*a,b* may calculate the force applied by the CPM motor by measuring the motor current during the power on pulse at analog input AN2. Applied CPM motor voltage is also measured during the power ON pulse at analog input AN3, using ratiometric conversion with a 2.50 V reference at analog input AN4. Average motor power, which is proportional to the applied force, is calculated by multiplying current times voltage times the ratio of the power ON period to the total power ON plus power OFF period.

The controllers 10*a,b* may also determine CPM motor speed by measuring motor back EMF, during the power OFF period, for example, at analog inputs AN5 and AN6.

While detecting the motor speed data at pin INT2, if the microprocessor 50 senses CPM motor motion when no motion is desired or the motor motion exceeds predetermined limits as determined by data stored within memory (not shown) of the microprocessor 50, the microprocessor 50 discontinues sending data to the motor via pin A4 and deactivates pin A3 which causes the motor to stop running. Simultaneously, an output is transmitted from the microprocessor 50 to the LCD display 40 for displaying a message that a fault has been detected by the microprocessor 50. It will be understood that controller 10*b*, likewise, stops the operation of the motor and displays a fault message on display 40 under these circumstances.

The type of CPM device which is connected to the controllers 10*a,b* is determined by the code presented on the cable 22, connecting the CPM device to the controllers 10*a, b*. The CPM type code is sensed by the microprocessor 50 on input pins C5–C7, which selects from a ROM table the specific orthosis parameters that set the absolute predetermined limits on the user programmable parameters. The CPM type code also enables or disables specific function keys, sets default parameters for the disabled keys, determines orthosis motor speed and force relationships and display parameter scaling.

Referring specifically to FIGS. 3A–12B, there are shown a series of flow charts depicting the software operations of the universal controllers 10*a,b*. In addition, the attached Appendix provides an example of a program used to implement the functions of the controllers 10*a,b*. The main purpose of the controller software is to control the amount of power transmitted to a particular CPM device so that the CPM device provides substantially constant angular velocity between set angular limits at set angular speeds and within set force limits. Alternately, the CPM device may be in a dynamic tension mode wherein a continuous constant force is applied to a joint under treatment. A secondary purpose of the controller software is to provide a means for entry, display, update and retention of the CPM device operating parameters. The controller software also provides diagnostic analysis of the hardware state of the controller with fail-safe fault shut down and diagnostic and calibration displays.

Typically, a motor is associated with each CPM device and controls the motion of the device. Motor control is achieved by pulse width modulation of the CPM motor power, with motor tachometer and angular position feedback. A power ON pulse width is set by the tachometer pulse indicating that the motor is in motion. An OFF pulse width is set by a transfer function that uses the tachometer count calculated during the previous OFF period, the present angular position and the desired speed of the motor. The control of the ON pulse assures that sufficient power is applied to overcome inertia, friction and motor reflected load. During the OFF period, the tachometer count provides an indication of motor coast which compensates for varying loads. Angular position feedback compensates for the trigonometric relationship of motor speed to controlled joint angular speed. The desired speed determines the nominal OFF period.

For a CPM device which is a direct drive orthosis device, the motor tachometer pulse rate is directly proportional to the angular rate and the constant of proportionality is the motor and orthosis gearing. Therefore, a direct drive orthosis device maintains constant angular speed by maintaining a constant tachometer pulse period.

For a CPM device which is an indirect drive orthosis 10 device, the motor causes a change in length of one of the sides of a triangle that changes the desired angle. For example, for a knee orthosis device the common configuration for the knee CPM device is to change the base length (b) of the triangle where the knee angle (K) is the vertex with an offset angle of (Q). The base length is normalized to the leg frame (F) and is the square root function of COS (K+Q), where K is the knee angle and Q is the drive offset angle. The first derivative of the base length verses the angular position results in the expression of base length velocity for constant angular velocity, also normalized to the leg frame. The desired base length velocity curve is a function of equation $$\sin(K+Q)/\sqrt{\cos(K+Q)}\ .$$

At constant motor speed as opposed to constant angular velocity, the angular velocity at the desired pivot point or knee angle at low knee angles can be significantly higher than the desired nominal angular velocity. This causes a feeling in the patient that the knee is in free fall with no support from the orthosis device. By modifying the motor speed by using pulse width modulation, it is possible to obtain an approximately constant angular velocity at the knee angle which results in comfortable motion with constant support from the orthosis device.

The force limits of the device are set dynamically 10 by an initial cycle for a histogram profile as will be discussed in detail hereinafter. The force is determined by measuring the voltage and current of the motor ON pulse and calculating the actual applied average motor power. A profile of the required peak force to achieve desired motion periodically is built during the initial cycle for a predetermined degree of angular motion in each direction. In the preferred embodiment, the peak force is the maximum force of all measurements for every 16 degree segment of angular motion in both the flexion and the extension direction. The profile, with appropriate offsets, sets force limits for all future cycles and compensates for various patient loads, varying angular leverage arm and mechanical and motor efficiency and friction. The histogram profile also provides sufficient force resolution to detect potential jams or patient problems at all points of the cycle and causes motion reversal to clear the jam or relieve patient discomfort. The force limits set the allowable increase in force for an additional percentage of the force profile at each segment motion and can be fixed or programmed within orthosis limits as will be described hereinafter.

The CPM controller software may consist of separate functional modules which will be described in detail hereinafter. A program for implementing the functional modules is set forth by Telepko in Universal Controller for Continuous Passive Motion Devices, U.S. patent application Ser. No. 07/760,424. The functional modules reside in a nonvolatile ROM located within the microprocessor 50. The modules are preferably written in assembly language and are compiled by an assembler.

The CPM controller software also contains two definition modules. The first definition module is REGS module which defines the registers used by the CPM functional modules. The REGS module contains 256 registers which are grouped by their general usage. The first register is an RFLT register which is normally set at zero. Each bit in the register if set indicates by its particular position a particular detected fault. The RFLT register is analyzed and cleared by a HLTCK module which will be discussed hereinafter.

A second register is the RSYS register which is the CPM limit flag register. Each bit of the RSYS register if set requires coordinated action between the functional modules. A PRR bit located within the RSYS register indicates automatic correction of parameter, and requires examination of parameters and locks out the run mode and motor motion. HS and HC bits also located within the RSYS register indicate a requirement for building up the force profile histogram. A 1SC bit indicates the requirement for time related actions, if any. Other bits indicate whether the orthosis device is within the parameter angular limit at extension or flexion and an additional bit indicates the high force limit required for reversal of motor motion.

The RPSVT register to RGDSP registers provide time out counters, keypad and display bit flags and orthosis or mode related pointers. An RTONF register is a motor power ON tachometer pulse count register which provides an improved low speed high load performance with drive back lash.

The REGS module also contains operating parameter registers. The REXTL register to the RTIM registers are user set parameter holding registers. The contents of these registers is in binary logical engineering unit values, which is modified for display based on the type of CPM device. An RMOT register is a motor/-motion control register which operates by bit position. The RMOT register indicates the critical points in the motion cycle. A GO bit within the RMOT register indicates when motor motion can be initiated. An E/F bit indicates the direction of motor motion. An SRV bit indicates the requirement to stop and reverse motor direction. APSE bit indicates the pause time period. An FLD bit indicates the first limit delay period invoked on motor motion start while the motor is accelerating. The ODS and BLK bits are run time display control bits and an FAC bit is a power fail during motor motion restart bit which forces auto call on power restoration.

The REGS module further comprises register arrays which comprise one or more registers which are used to provide timing or value averaging functions. These arrays include a TA array which is an angle processing table, a TC array which is a current processing table, a TV array which is a voltage processing table and TW array which is a power processing table. In each array, the last register holds the processed value. Timers within the microprocessor 50 generally count time in 20 milliseconds (MS), 1 second or 1 minute increments. Up/down timers count time in cycles through an executive main loop which will be discussed in detail hereinafter and provide increasing rate value increment-/decrement update functions. A TCC array comprises 32 registers in which 31 of the registers contain a force profile histogram and the 32nd register provides histogram control.

An RW register is a watchdog register which provides capabilities for a watchdog reset. At any point in the operation of the CPM device, if the contents of the microprocessor 50 program is corrupted, a watchdog restart will result.

A second definition module contained within the microprocessor is a PORT module which defines the input/output ports and parallel hardware of the microprocessor 50. A PAD port and PMOT port are CPM control output ports. The PAD port and PMOT port control the neuromuscular stimulator (NMES) relays, motor direction, off switches during pulse width modulation and keypad column selects. The PBD and PDD ports are display interface ports. The PBD port provides display data and control output (write) and status input (read). A PCD port is a CPM keypad and orthosis type input port. The keypad is preferably a matrix pad with driven columns and sensed rows.

A PINT2 port is an external interrupt 2 control port for the CPM motor tachometer monitoring. A PTIx port is a timer 1 control and data port. Timer 1 generates interrupt 5 which is used for motor power pulse with timing in conjunction with the tachometer interrupt. The motor tachometer generates 15 pulses per revolution of motor armature or 750 Hz square wave at 3000 rpm. A PT2x port is a timer 2 control and data port. Timer 2 generates interrupt 8 at 20 MS rate for CPM timing and key board scan functions. A PADx port is an A/D selection, data and control port. The 8 bit analog to digital converters are used for measurement of angle, motor current and raw and reference voltages.

Figure 3A:
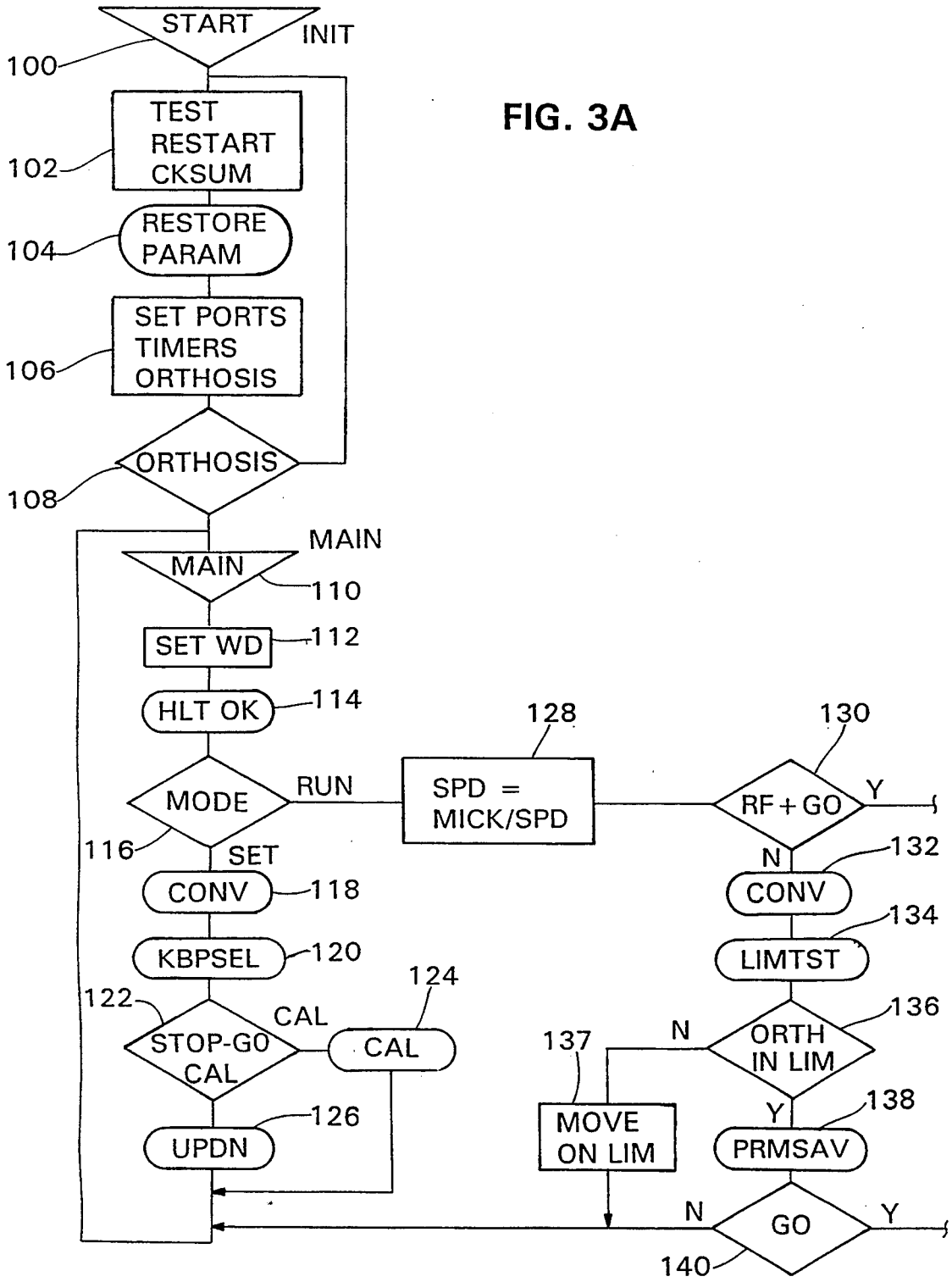
FIGS. 3A–12B are flow charts depicting the operation of the CPM control of FIG. 1.
Figure 3B:
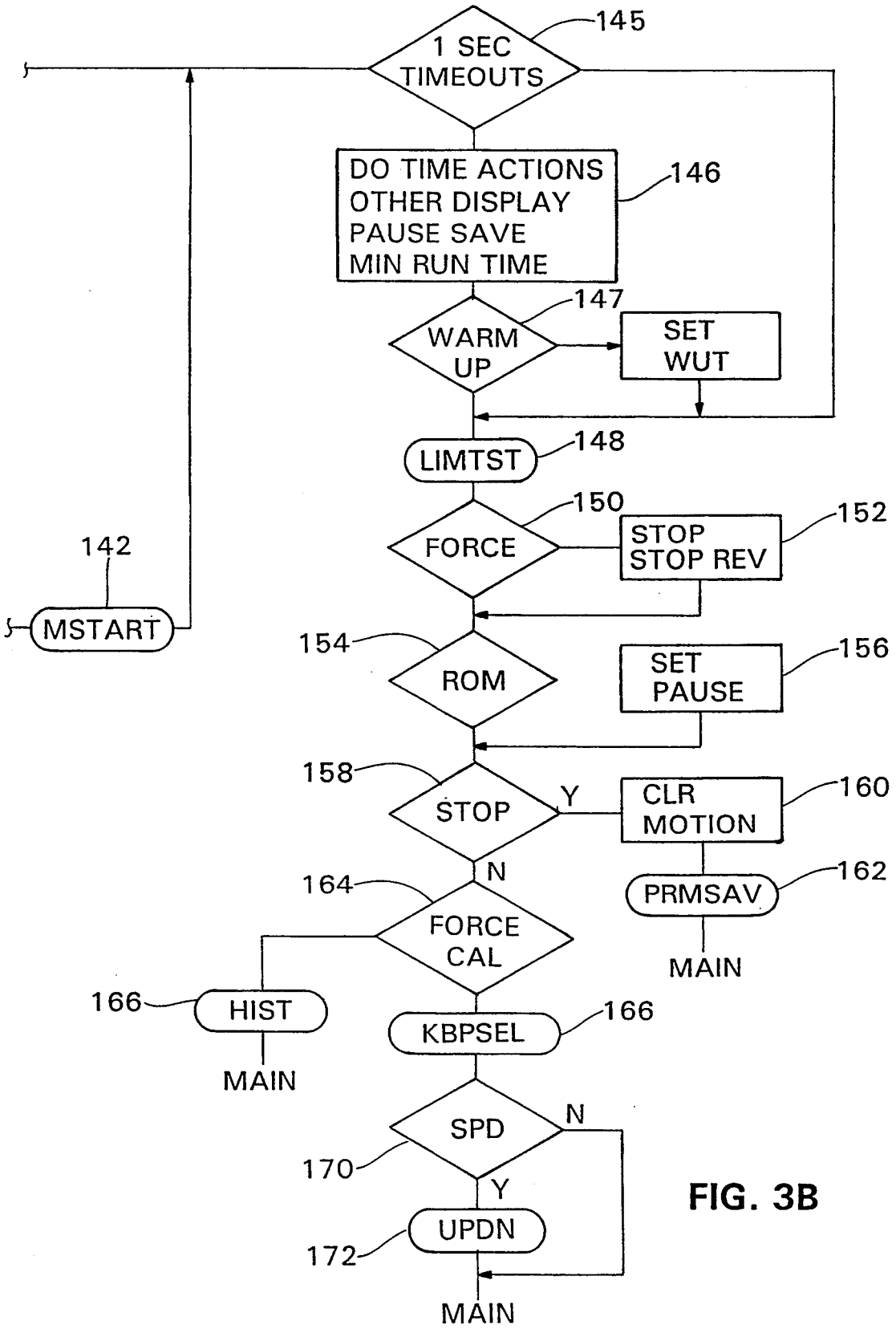

Referring specifically to FIGS. 3A–3B, there is shown a flow chart depicting the functions performed during the INIT module of the controllers 10*a,b* coupled to the CPM device. The INIT module performs power ON and restart initialization. The INIT module is entered at block 100 when power is initially received by the controller 10 or when a hardware generated restart occurs, such as when a detected fault is corrected. When the INIT module is initially entered, a ROM check sum is calculated at block 102 and compared to a check sum value which is stored within the EEPROM. If the check sum values do not match, then the value discrepancies are recorded in a RFLT register located within the microprocessor 50 which records and maintains a record of all faults detected within the controllers 10*a,b*. Once the check sum values are determined to be equal by the controllers 10*a,b*, the registers are cleared with the exception of the RFLT register. At this point, parameters stored within the EEPROM are restored to each respective register and the pause bit PSE is reset at block 104. Once the parameters are restored, all ports and timers associated with the microprocessor 50 are set at block 106. Timer 2 is set to 20 MS, low priority, timer 1 is set to maximum motor ON time which equals 1.1 sec. and the watchdog timer is set to a 3 second timeout.

At block 108, a determination is made whether an orthosis device is connected to the controller 10*a,b*. If an orthosis device is connected to the provided controller 10*a,b* the orthosis type is determined by a cable connector code which is received by the microprocessor 50 at pins C5–C7. If no orthosis device is connected to the controller 10*a,b* no reading is detected by the microprocessor 50 and the INIT module goes back to start and reinitializes the controllers 10*a,b*. Motor OFF switches are tested to verify that each can turn off motor power. In the final stages of the INIT module, the watchdog is enabled, motor power state is restored, a one second wait is enforced for orthosis type display, global interrupts are enabled and control is transferred to the MAIN loop.

The INIT module executes with interrupts OFF, therefore, timing is provided by software loops. A UNUS trap code sets all fault bits and UNUS# interrupt entry points identify the interrupt by a count display as at least two digits of the fault display. An OTYP table contains orthosis type nomenclature and is updated as additional orthosis type devices are implemented.

A 16 byte orthosis type table TYPT provides control and absolute orthosis limits. The first byte of the TYPT table provides angle offset from a positive logical software angle for use when the zero set calibration feature of the present invention is used. The controller software stores all angles in the 0° to 192° range and the offset is subtracted prior to display of the actual orthosis physical angle.

The zero set calibration feature of the present invention is a position offset value that compensates CPM position read outs for offsets. The offsets may be due to such things as swelling, the orthotic itself, or the orthosis padding and other orthosis soft goods. When the controllers 10*a,b* are used with a wrist orthosis, the diameter of the wrist of a patient and the selected hand rest can offset the wrist angle from the CPM readout. By using the parameter selection input keys 41, 43 and up/down input keys 32, 34 the patient can compensate for factors such as these. To do this the orthosis is moved, while the zero set is selected, until the wrist of the patient is straight. This is defined as the zero angle using up/down input keys 32, 34. All CPM position read-outs are automatically adjusted for this offset. The adjusted readouts may include, for example, extension limit, flexion limit and angle. The zero set parameter is selected in the controller 10*b* using parameter selection keys 41, 43.

Figure 13A:
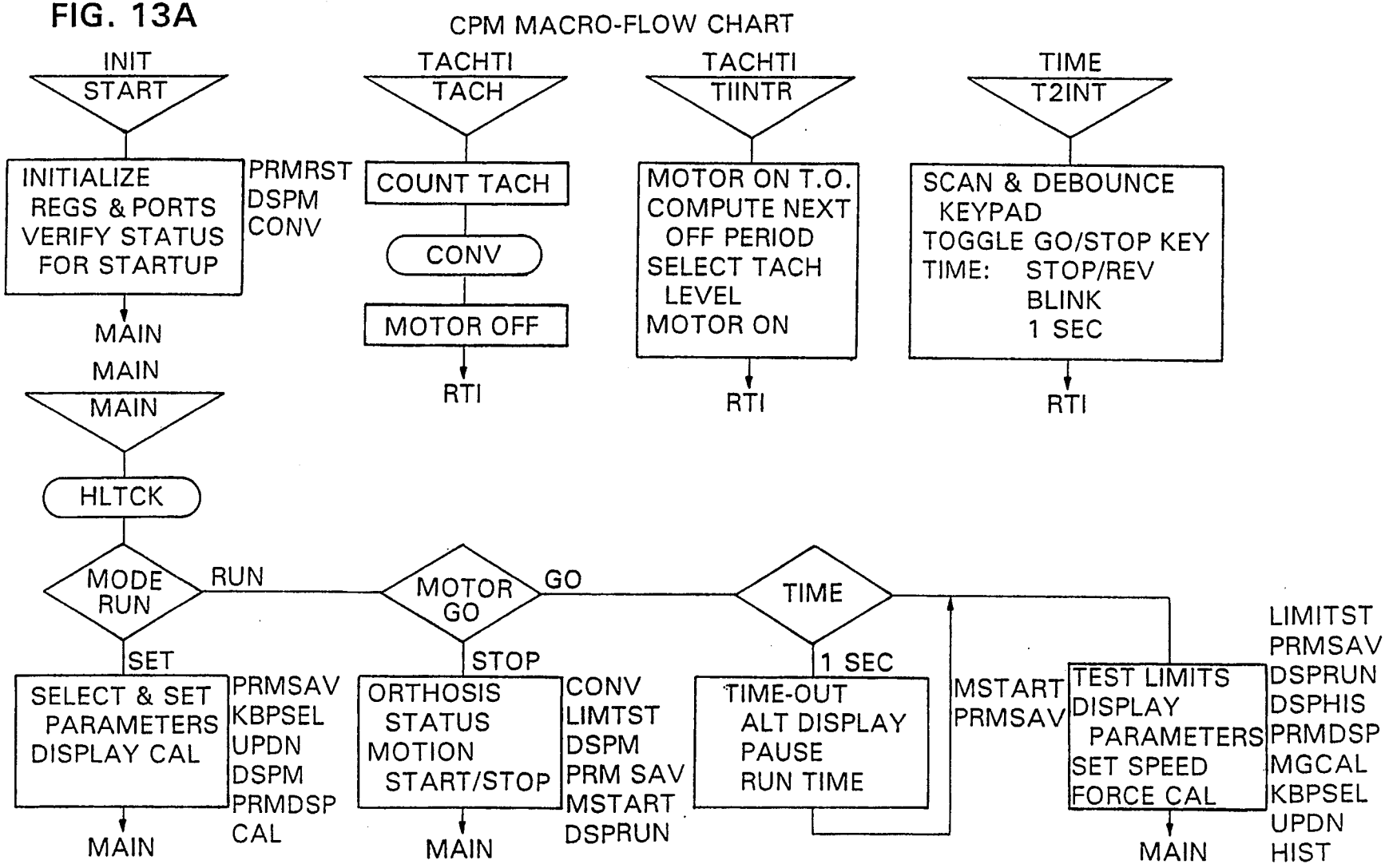
FIG. 13 is a macro flow chart of the flow charts depicted in FIGS. 3A–12B.
Figure 13B:
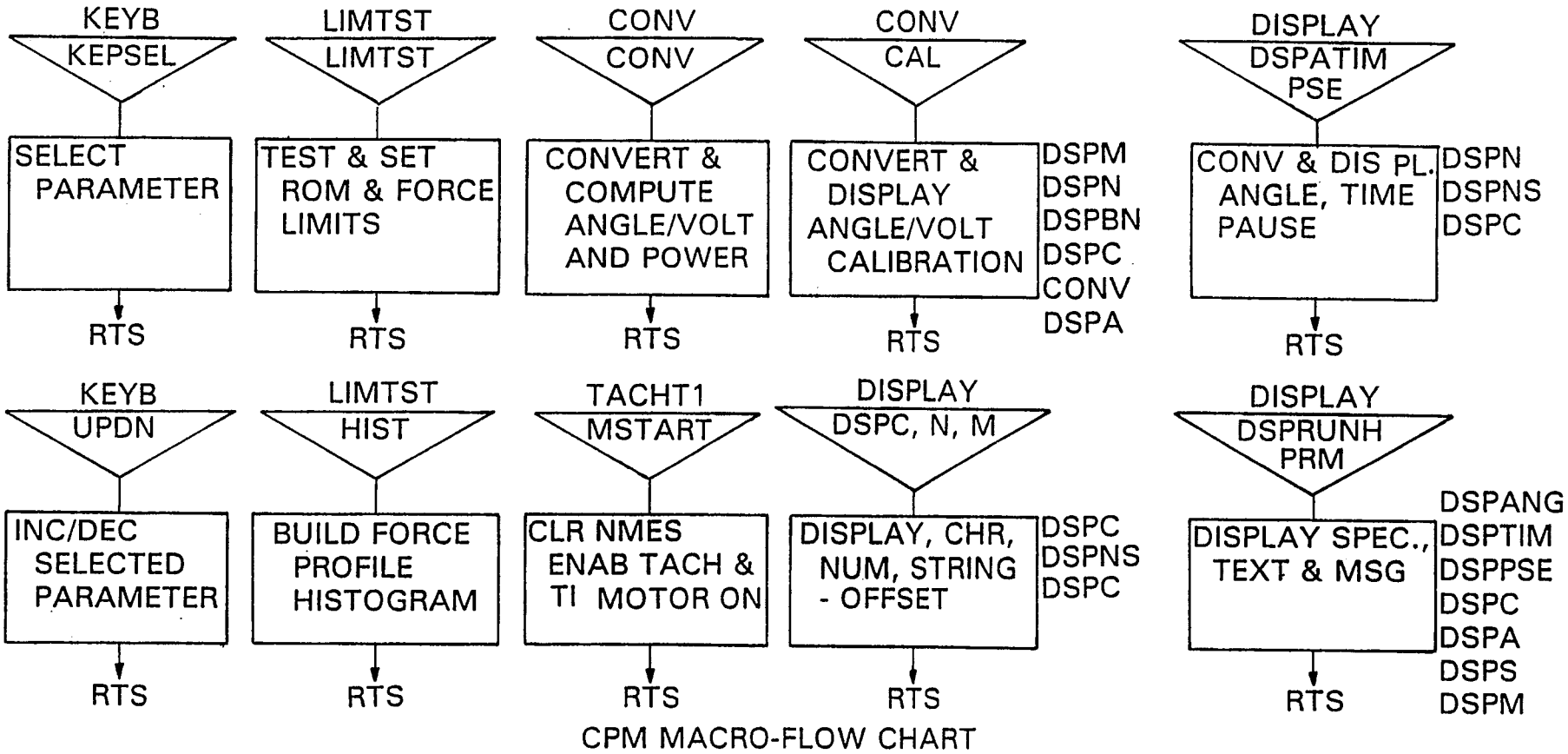
Figure 13C:
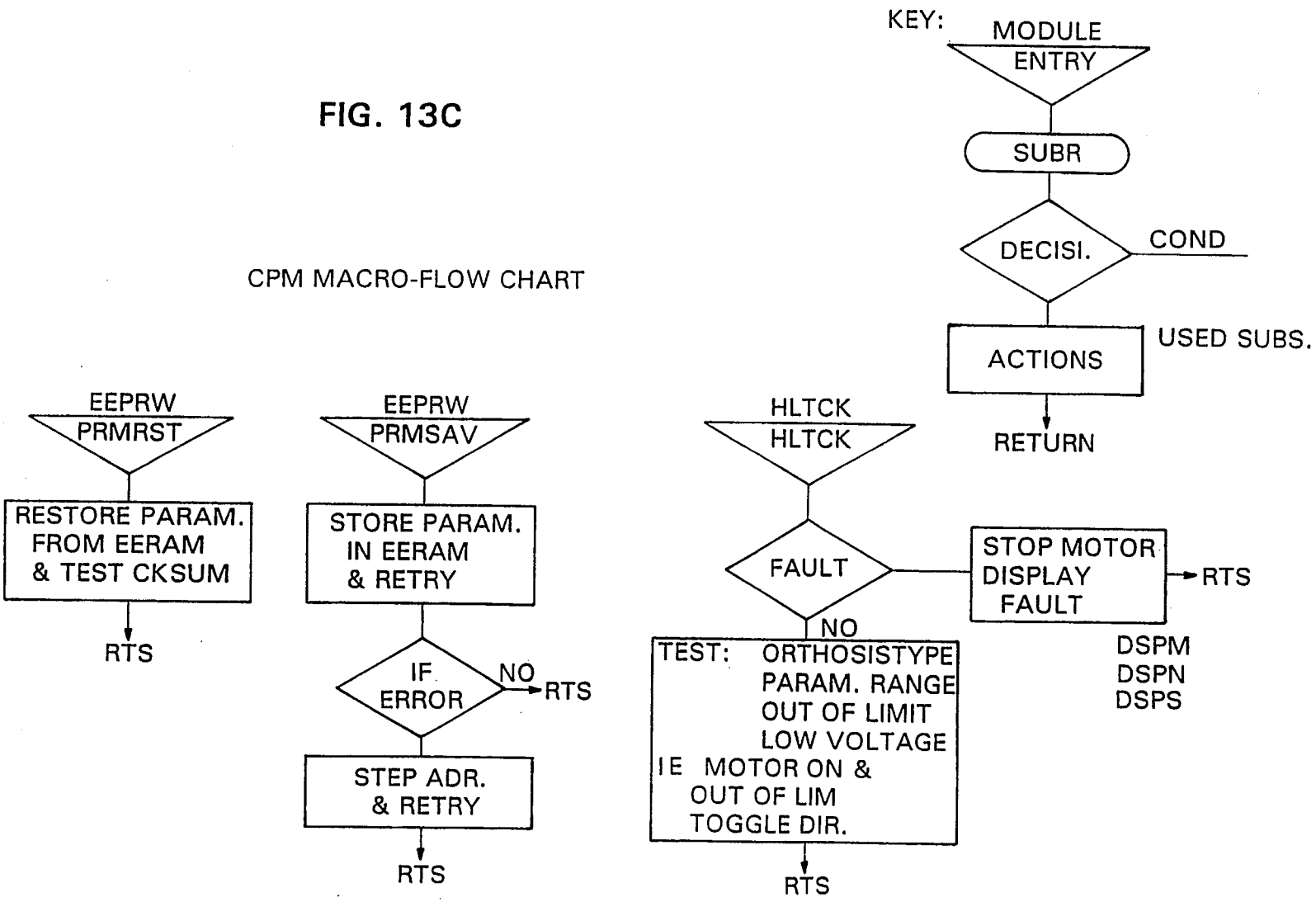

In the preferred embodiment the wrist orthotic may provide 0° to −30° zero set adjustment. This range permits compensation for most offsets which are likely to be encountered. The zero set value is stored as part of the treatment parameters and is subtracted from all positional values prior to being shown on display 40 as shown in display routine 1350 of FIG. 13B. The stored zero set value may later be readjusted with the up/-down input keys 32, 34 of the controllers 10*a,b*.

Alternately, the zero set value may be set using orthosis motion by holding the go key 36 while using the up/down keys 32, 34. In either case, the final value of zero set is adapted to be the mechanical CPM position when the wrist is placed in a straight position thereby causing the patient's wrist angle to be zero. A program, understandable to those skilled in the art and effective to perform the functions set forth herein as the zero set calibration feature, is attached as an appendix. The zero set value is set in the MAIN module of this program at PQZU and PQZD in the appendix. It is used in DSPLAY module of this program at DSPA.

The second byte of the TYPT table contains drive type information which identifies orthosis and control capabilities. The third byte of the TYPT table contains minimum speed parameters in degrees/minutes. A fourth byte contains the maximum speed parameter which in the preferred embodiment is the equivalent of up to 80% of the motor speed. A fifth byte of the TYPT table provides a minimum extension angle. A sixth byte for the TYPT table provides a predetermined limit for the maximum flexion angle. A seventh byte provides a predetermined limit for the minimum force or fixed extension force. An eighth byte provides a predetermined limit for the maximum force or the fixed flexion force. The ninth through eleventh bytes provide the SK speed parameter.

For direct drive orthosis device, the equation for determining the SK speed parameter is as follows:

$$SK=(60\ s/m*orth\ deg/rev)/(motor\ GR*PRI*85.33\ E\text{-}6) \quad (1)$$

For an indirect orthosis type device the equation for figuring out the SK speed parameter is as follows:

$$SK=(AK*60\ s/m*orth\ deg/rev)/(GR,PRI,85.33\ E\text{-}6) \quad (2)$$

The twelfth byte of the TYPT table provides a AK linear or approximation offset for the velocity slope. The thirteenth byte provides an RMT potentiometer reversal and motor current scaling. The fourteenth byte acts as a spare byte and is not used by the controller. The fifteenth byte provides the maximum power limit during a histogram profile cycle set at 32 D/M max less than 80 counts. The sixteenth byte provides frictional force set at 64 D/M (approximately 0.5 multiplied by the lowest no load force).

The force limit is defined as a percentage of the force profile and is calculated as follows:

$$Force\ Lim=Profile\ Force*(1+(Set\ Force+1)/8) \quad (3)$$

A table of the set force and limit is set forth as follows:

| Set Force | Limit |
|---|---|
| 1 | p* 1.25 |
| 2 | p* 1.375 |
| 3 | p* 1.50 |
| 4 | p* 1.625 |
| 5 | p* 1.75 |
| 6 | p* 1.875 |
| 7 | p* 2.00 |
| 8 | p* 2.125 |
| 9 | p* 2.25 |
| 10 | p* 2.375 |

In the above table, p is the peak value in the 16′ segment that was required to provide desired motion during the force calibration cycle. In the controller 10*b* the set force is in pounds.

Once the initialization phase is completed, the software enters a MAIN functional module. The MAIN module is the main executive loop that controls all states of the microprocessor within either of the controllers 10*a,b*. Once the MAIN module is entered, the program continuously loops in one of four subprograms which are as follows: a set mode, a go mode, a run/stop mode, and a run/go mode. The MAIN module controls all states of the CPM device. The CONV subroutines and CAL subroutines perform A/D conversion and angle/voltage calibration. The DSPM, DSPRUN, DSPHST and PRMOSP subroutines perform LCD display functions. The LIMTST and HIST subroutines provide operational parameter limit testing and histogram building capability. The MSTART subroutine initiates motor motion. The KBPSEL and UPDN subroutines perform keypad parameter selection and up/-down update capability. The PRMSAV subroutine provides parameter retention capability.

The set mode path disables timer/interrupt, performs conversion through the CONV module and if the motor GO is set, clears the run/go mode and saves the parameters within the microprocessor EEPROM memory. In the case of controller 10*a* the keypad 24 is examined for the parameter selection or calibration mode. The CAL mode is selected, the CAL routine performs appropriate conversion and display prior to looping to the MAIN module. If the CAL mode or any other parameter is not selected, "SELECT PARAMETER" is displayed on the LCD display 40 and the program loops to the MAIN module. If a parameter is selected and the controller is in the set mode, a display type flag is set for the "push-go" message and the parameter range fault is cleared. The UPDN routine is called for possible parameter update. The modified selected parameter is displayed and program loops back to the MAIN module.

If the run/set switch 38 is in the run mode, the run program branches to MAINR, and the double precision speed period is calculated. The constant SK is selected to provide a closest minimum speed at maximum flexion angle. If the RMOT power fail restart or GO bit is set, the program branches to the run/go mode. In all other instances, the present angular position is determined by the CONV module followed by the LIMTST module to determine if the orthosis device is within the proper set limits. If the orthosis parameters are outside the set limits, a message is displayed on the LCD display 40 which indicates that the orthosis needs to be reset. If the UP key 32 is depressed, the motor is powered in the closest direction to bring the orthosis device within the closest limit and the program loops back to the MAIN module. If the UP key 32 is released, motor motion stopped and the program loops back to the MAIN module and displays the previous message.

If the orthosis device is moved within the set limits, motion, if any, is discontinued. If the RGDSP register is clear, the program entered the run from set mode causing the parameters to be saved and the "push-go" message is displayed, otherwise the "run" display is continued. Once the GO key 36 is set, verification that it is the only key depressed assures intentional action. The display pointer is set to the last selected parameter, the GO bit is set, the parameters are saved indicating the controller is in GO mode, motor motion has started and the program branch is to the run/go mode.

The MANIG routine is organized in three functional groupings. The first grouping contains time dependent actions, the second grouping comprises motion and limit control functions and the third group comprises parameter selection with histogram build functions. The force histogram may be displayed at any time by depressing the force and time keys 31, 35. The force histogram displays are in encoded units of power but force limits are set in percentage and histogram force power.

The time dependent actions comprise timing out of other displays that overlay the run display, countdown of pause display with associated direction reversal and neuromuscular stimulator control, stepping of the minute counter and updating of run time. The motion and limit functions comprise calling on the limit test to set appropriate flags in determining the time to enforce the force limits which set the stop/reverse of the motor and first limit delay. If the stop key 36 is depressed, motion is stopped by resetting all but the direction bit in the RMOT register which stops motion in the next motor power OFF period. In addition, the parameters are saved to reset the GO bit and to clear the pause timeout which could cause motion restart on timeout and the timer/interrupt is reset to prevent on/off timing. The MAIN module is then taken out of the run/go mode. If a parameter is selected, the default "run" display is displayed and the program loops to the MAIN module.

A call on MGCAL provides histogram building and display capabilities. Otherwise, the KBPSEL module is called to set the selected parameter, the selected parameter is displayed and if allowed to update the UPDN routine is entered. All key depressions, including up/-down during permissible parameter, reset the other display timeout to 5 seconds. The MGCAL program calls on histogram build and if the force and time keys are depressed displays a force histogram appropriate to motor direction. A WAIT routine provides a 1 second program execution pause based on approximately 300 k instruction per second execution rate.

The MAIN module is entered at a main entry point entitled MAIN at block 110. The MAIN module always starts by resetting the watchdog timer at block 112 followed by a check of the integrity of all of the parameters at block 114. Once all the parameters have been checked and recalibrated, if necessary, it is determined whether the set/run switch is in the set mode or the run mode at block 116. If the run/set switch is in the set mode, all parameters inputted into the controllers 10*a,b* can be modified. At this point, the CONV functional module is entered which performs angle, voltage and current measurements relating to the angular position and force of the specified pivot point of the CPM device and current and voltage measurements from the CPM motor at block 118.

Figure 4:
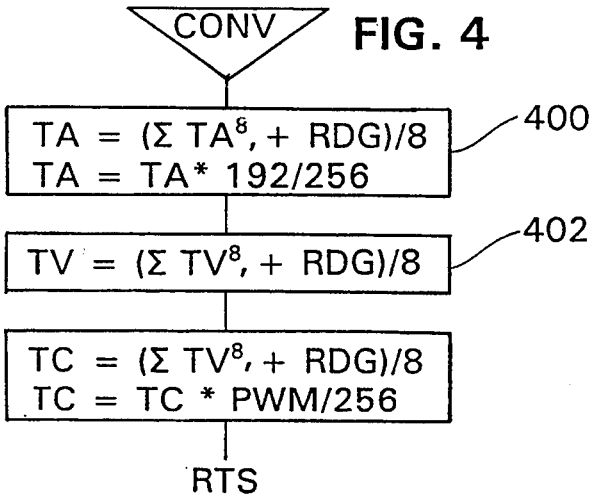

Referring specifically to FIG. 4, the CONV module determines angle, voltage and current measurements with eight point averaging, angle scaling to logical degrees and power calculations within either controller 10*a* or controller 10*b*. The averaging and calculation of measurements are interlaced in time with channel selection and conversion, using a straight line code optimized for minimum total time. The CONV module performs all analog to digital conversions and calculations.

To determine the angle measurement, first an eight point averaging occurs in which seven previous angle readings made by the sensor at the pivot point and stored within the memory of the microprocessor 50 are added to the current angle reading. The sum is divided by 8 to obtain an average angle reading at block 400. The average angle reading is scaled at 0.75 degrees per count increments. Next, the averaged angle is rescaled by multiplying the sum by 192. The product is rounded off and divided by 256 to obtain the scaled logical angle 1° per count at block 400.

The voltage is only averaged and the result represents actual unregulated voltage with 10.4 volt offset and 0.02 volt per count resolution. The voltage measurements of the CPM motor voltage are averaged by summing the seven previous voltage measurements which are stored within the memory of the microprocessor 50 and the present voltage measurement. The sum is divided by eight to obtain an average voltage reading at block 402.

An average current measurement of the CPM motor current is taken by summing the seven previous current readings stored within the memory of the microprocessor 50 and adding the present current reading. The sum is divided by eight at block 404. Once the average current reading is obtained, it is multiplied by the pulse width ON-to-OFF ratio and the voltage which is the average motor power or the instantaneous force produced. The power is average for 16 points and represents 0.4 watt count.

Once the CONV module is exited, the KBPSEL function of the KEYB module is entered at block 120. The KBPSEL routine tests key depressions in masked groupings for a quick exit if no applicable keys are depressed. Potentially conflicting keys are resolved by arbitrary priority processing, extension takes precedence over flexion, pause over force and limit is default. Time selection takes overall precedence and speed is the lowest priority, i.e., processed if no other parameter key is selected. All selections cause reset of previous parameters and selection of the depressed key or default parameter as indicated by the bits in the RDSP register.

Figure 5:
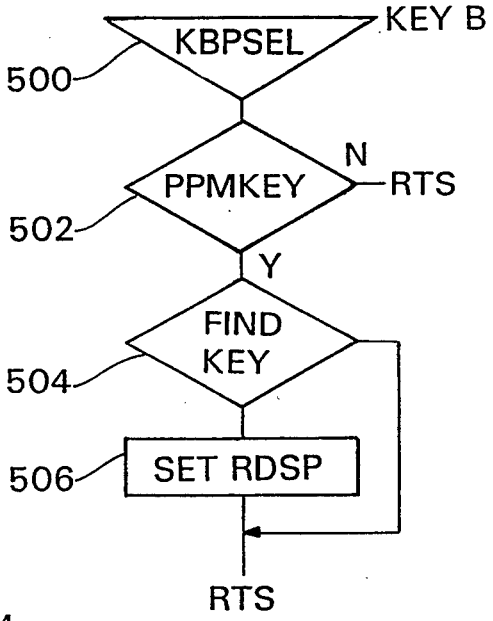

Referring specifically to FIG. 5, the KBPSEL function allows for parameter selection within the permitted parameters for the specific CPM device connected to either controller 10*a* or controller 10*b*. The parameter is selected by depression of a function key on the keypad. The function keys are extension, flexion, speed, force, pause, time and warm up time in controller 10*a*. In controller 10*b*, a parameter is selected from a list by the keys 41, 43 and the block 506 sets RDSP by stepping to the next or the previous displayed parameter. The parameter list includes the above functions with additional functions such as set zero, dynamic tension time parameters, and other operational or display related functions. The selection of a parameter overrides and resets any previously selected parameter at block 504.

Next, it is determined whether calibration display of the sensor associated with the CPM pivot point is desired at block 122. In the preferred embodiment, the sensor is a feedback angle potentiometer associated with the CPM. However, it is to be understood by those skilled in the art that any type of sensor may be used without departing from the scope and spirit of the present invention.

If calibration is desired, the processor enters the CAL subroutine at block 124 which indicates the angle, voltage and current of the orthosis device. The CAL subroutine is used to calibrate the orthosis feedback angle potentiometer and the control unit angle gain or ratio control. The CAL subroutine also monitors all voltages present in the control unit and displays the check sum.

Figure 6:
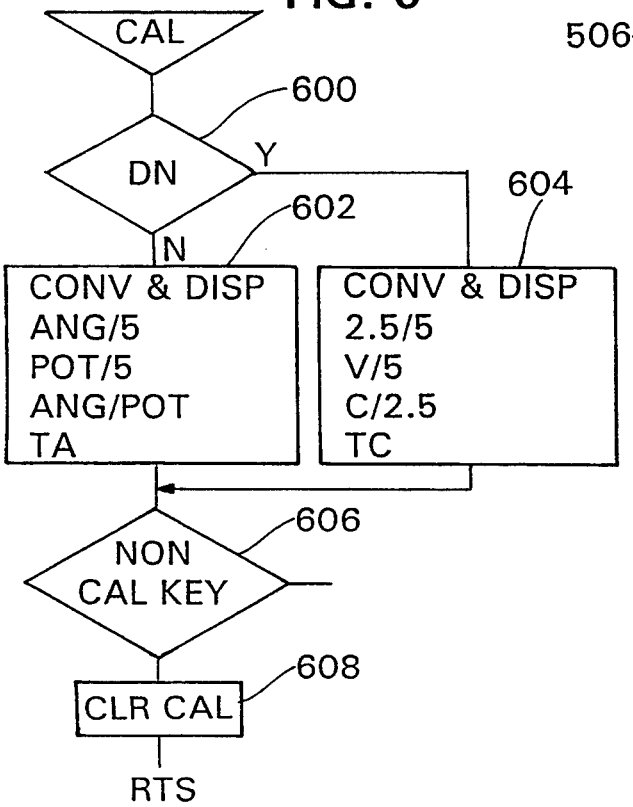

Referring specifically to FIG. 6, the CAL subroutine determines angle calibration of the specified pivot point within controller 10*a* or controller 10*b*. This determination is made by taking an actual angle reading of the angle formed at the pivot point proximate the joint which is being exercised by using a potentiometer to determine whether the sensor is properly calibrated at block 602.

The angle calibration performs three additional measurements in the CAL subroutine. Orthosis angle and angle gain is measured with respect to 5 volts, with 255 being the maximum voltage point. Next, the orthosis angle is measured against the gain which results in the unscaled logical angle reading of 1,333 counts per degree. Finally, the average scaled, with orthosis offset, angle is displayed which is the orthosis physical angle.

Voltage calibration display of the CPM motor occurs by enabling the down key 34 located on the front panel 14 of the controllers 10*a,b*. Voltage monitoring is performed at block 604. The first voltage reading is the 2.5 reference voltage measured against the 5 volts and should result in 128 counts. The unregulated voltage is measured against 5 volts followed by the motor current against 2.5 reference volts. Finally, the average current, with no pulse width scaling is displayed on the LCD display 40 at block 604. A check sum is displayed when the UP key 32 is depressed. The CAL subroutine is exited when any new parameter is selected by the input keys 24 at block 608.

Figure 7:
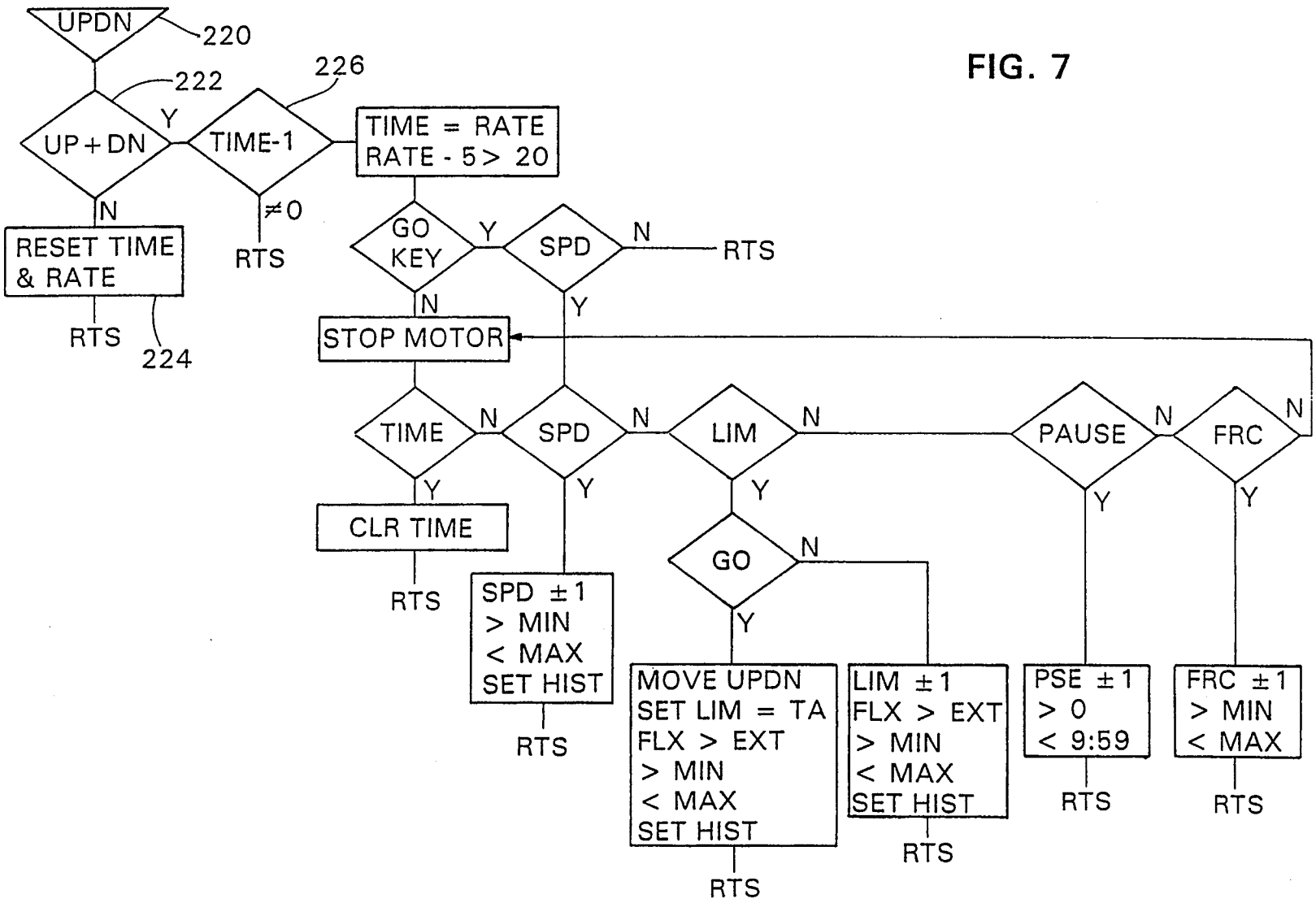

If calibration is not desired, the processor 50 enters the UPDN function of the KEYB module at block 126. The UPDN function requires knowledge of absolute orthosis limits which are obtained from the TYPT table. Referring specifically to FIG. 7, the UPDN function allows access to the up key 32 and the down key 34. First it is determined if either the up key 32 and the down key 34 is activated at block 702. If no time is available, the time is set equal to the rate at block 708. Next it is determined whether motor GO bit is set at block 710. While previously selected parameters, by the KBPSEL function are being increased or decreased by use of the up key 32 or the down key 34, the processor verifies that the CPM motor is off.

If the user selects the speed key 30 of controller 10*a* or the speed parameter using keys 41, 43 of controller 10*b* at block 718, the speed can be either increased or decreased by depressing the up key 32 or the down key 34. Once the speed has been altered, it is determined whether the new speed falls within the predetermined limits at block 720. If the speed is within the predetermined limits, the controller returns to the main module.

If the flexion key 26 or the extension key 28 is selected at block 722 using controller 10*a*, it is first determined if the corresponding key is also depressed at block 724. If the key is depressed, the CPM orthosis motion follows the flexion limit or the extension limit which can be either increased or decreased accordingly. Once the flexion parameter or the extension parameter have been altered, the microprocessor 50 determines whether the parameters fall within the predetermined limits. In a similar manner microprocessor 50 makes these determinations within controller 10*b* when the flexion or extension parameters are selected using parameter selection input keys 41, 43.

If the force parameter is altered at block 734, it is determined whether the new force parameter falls within the predetermined limits at block 736. If the pause parameter is altered at block 730, then the pause timer can be set between 0 and 10 minutes at block 728. If any of the parameters are increased or decreased beyond the orthosis capability stored within the processor, then the specific parameter is defaulted to a value which is determined by the orthosis type. Once the UPDN function is exited, the processor returns to the beginning of the MAIN module.

If the run mode is selected at block 116, it must first be determined whether the motor is on or off, which is determined by whether the go/stop key 36 is in a stop mode or a go mode at block 130. If the go/stop key 36 is in a stop position, the processor enters the CONV module at block 132 which performs all analog to digital conversions and calculations as discussed in detail above. Once all calculations have been completed, the processor enters the LIMTST module at block 134 determines if the orthosis device is within the set limits. If the orthosis device is no within the set limits, then an appropriate message is displayed and depression of the up key moves the orthosis to the closest limit.

Figure 8:
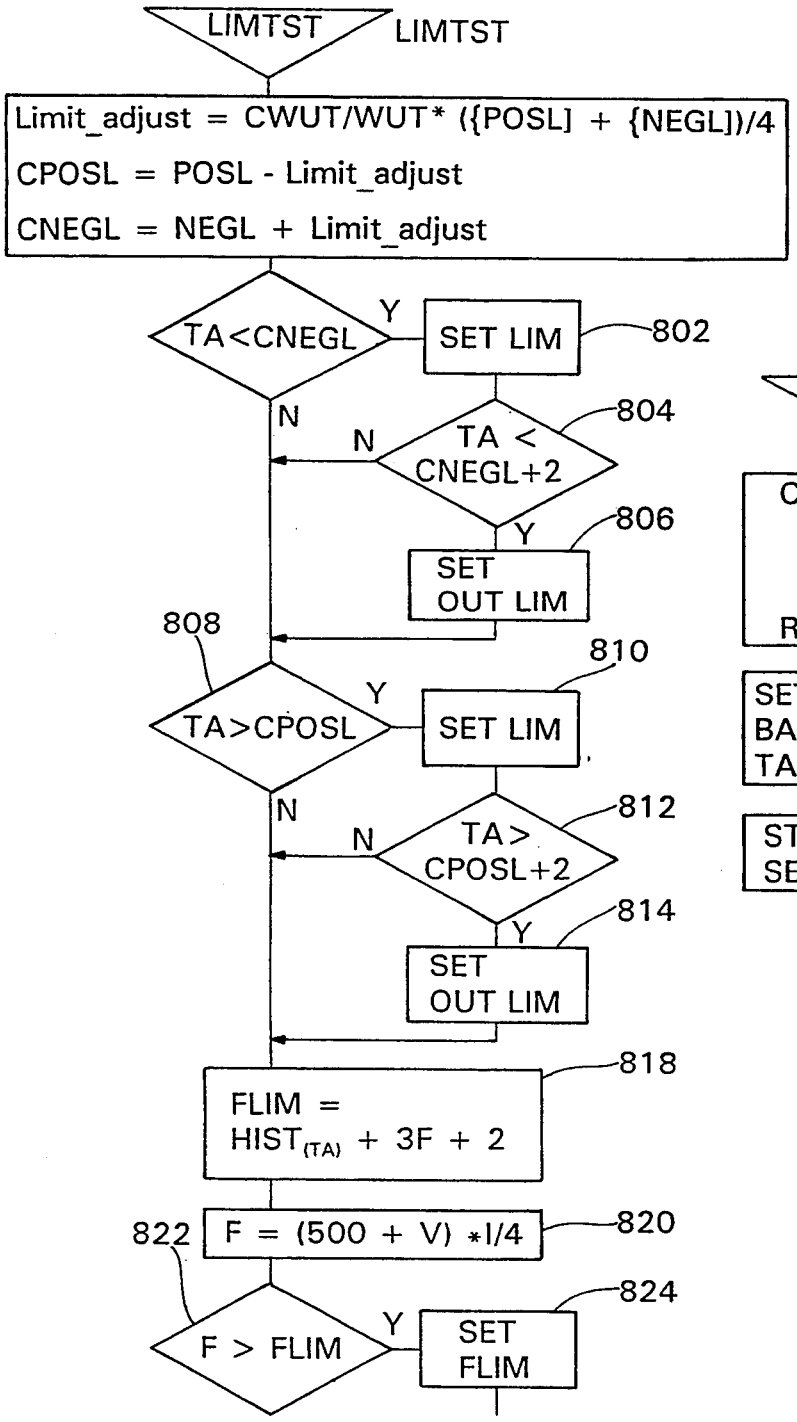

Referring specifically to FIG. 8, there is shown a flow chart representation of the warm up mode of the CPM orthosis device of the present invention. In the warm up mode the range of motion of the orthosis is automatically and gradually increased over a preset period of time. This warm up period permits the joint under treatment to gradually loosen up thereby minimizing initial patient discomfort. In the warm up mode of the present invention a user may set the rate of the gradual increase in the range of motion according to the desired period of patient joint loosening. If the warm up period is non zero, then the limits on the range of motion are initially reduced by one-half in order to provide an initial range of motion equal to half of the set range of motion. The limits are gradually increased to the originally set limits. The rate of this gradual increase is proportional to the ratio of the elapsed warm up period to the set warm up period.

During warm up there is no pause period at limit reversal. The display 40 indicates the computed limits, the message "WrmUp" with the remaining period in minutes. If warm up is interrupted by the stop function of the stop/go key 36, the message changes to "WrmUp Stop". The warm up can be resumed for the unexpired period by the stop/go key 36. However if power is turned off when the unit is stopped and the message "WrmUp Stop" is displayed, the warm up period is reset to the full period upon power turn on. In the warm up mode the warm up time parameter may be used to specify that no warm up is to be performed. This is done by setting the warm up time parameter to zero. Alternately, the duration of the warm up period may be set up to 255 minutes by adjusting the warm up time parameter accordingly.

If a nonzero warm up time is specified using the warm up time parameter, orthosis limits are offset equally to permit half of the specified range of motion. The orthosis position is checked to determine whether it is within limits. If it is not a "Set Orthosis Up?" message is displayed. When the up key 32 is depressed and held the orthosis moves toward the limit. It stops when it is in limit. This permits easy attachment of the orthosis to the patient.

As shown in block 800 when the orthosis device runs in the warm up mode, the limits are constantly adjusted by the following equations:

$$Limit_adjust = CWUT/WUT*([POSL]+[NEGL])/4 \quad (4)$$

$$CPOSL = POSL - Limit_adjust$$

$$CNEGL = NEGL + Limit_adjust,$$

where CWUT represents the remaining warm up period, WUT represents the set warm up period, [POSL] is the absolute value of set positive limit, [NEGL] is the absolute value of set negative limit and CPOSL and CNEGL are the current positive and negative limits respectively. The warm up mode, as implemented in MAIN module of the controllers 10*a,b,* thus requires initial limits and is implemented with continuous limit adjustment.

In the first limit test 801 of the LIMTST function the averaged orthosis angle (TA) is compared against the current negative limit CNEGL to determine whether the orthosis angle is within the specified limits calculated at block 800. If the orthosis angle is within the current negative limit then at block 808 it is compared with the current positive limit CPOSL calculated in block 800. If the orthosis angle exceeds the current negative limit CNEGL by 2 degrees, as determined at block 804, the out-of-limit condition is indicated at block 806. If the orthosis angle is not within 2 degrees of the current positive limit CPOSL as determined at block 812 an out of limit condition is indicated at block 814. It will be understood that if zero warm up time is specified blocks 801, 808 compare the orthosis angle with the previously specified extension and flexion limits and no gradual change in the range of motion takes place.

During operation, the force limit is calculated based on a histogram force profile which will be described in detail hereinafter. During the initial force calibration cycle, the force limit is based on an internal profile table located within the ROM which sets the orthosis capability force limits.

A histogram force profile is produced by the HIST function of the LIMTST module. The force profile histogram is developed in two steps. The first step clears the present histogram and resets the HC bit. The second step sets peak force values until the second occurrence of the first pause limit is detected with the opposite pause between the two occurrences. This assures a complete force profile in each direction of travel with possible stop/go reversals.

Figure 10:
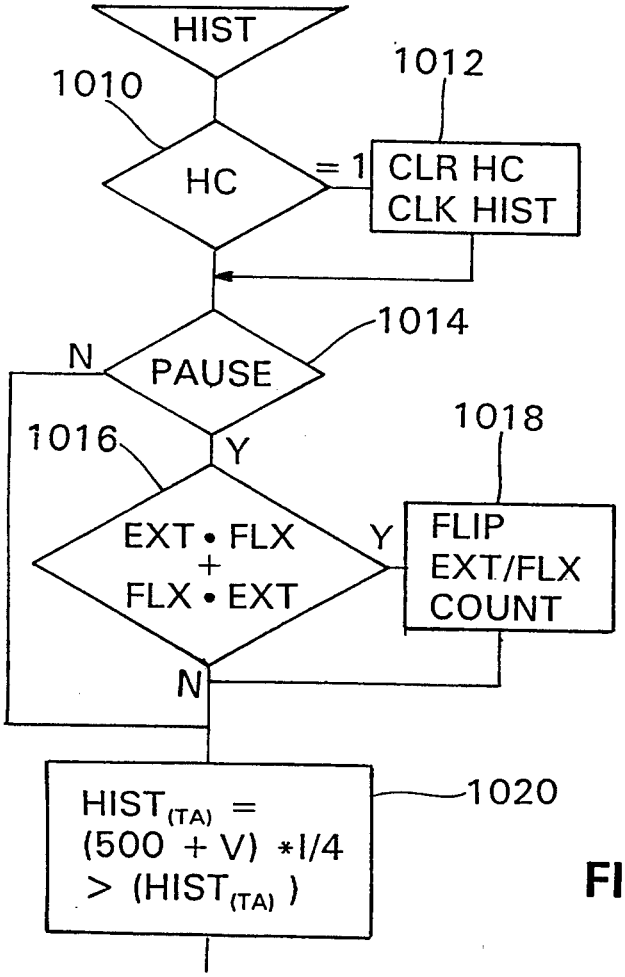
Figure 11:
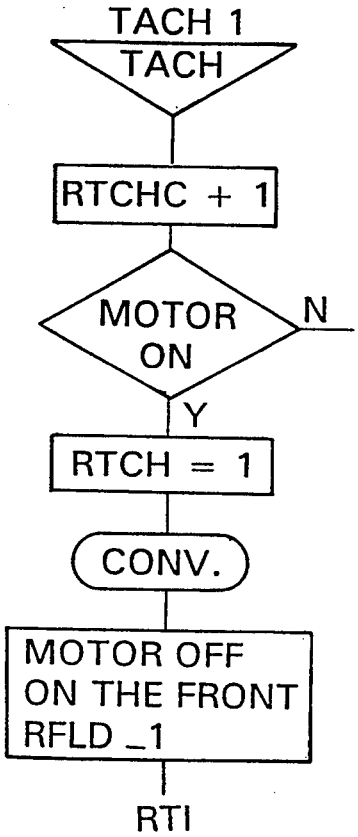

Referring specifically to FIG. 10, when the HIST function is initially entered, it is determined whether a previous histogram profile is to be cleared at block 1010. If a clear is required, the histogram is cleared and the HC bit is reset at block 1012. If no previous histogram profile exists then the histogram profile is produced during the initial cycle of operation. The histogram force is determined by measuring the voltage and current of the orthosis device motor power ON pulse and by calculating the actual applied average motor power. The average motor power is calculated based on motor pulse voltage times pulse width compensated current and scaled to 0.4 watts/count. The averaged motor power is compared against previous stored peak values and if greater the new values are stored as part of the force profile.

A profile of the required peak force to achieve desired motion is built during the initial cycle for every 16 degree segment of angular motion in each direction. It is to be understood by those skilled in the art that force measurements can be taken at any selected time and for any selected period without departing from the scope and spirit of the present invention. Determining force limits by using histogram profiles automatically compensates for various patient loads, motor efficiency and friction. The force limits also provide sufficient force resolution to detect potential jams or patient problems at all points of the orthosis cycle and can cause motion reversal to clear a jam or relieve patient discomfort.

Once the orthosis angle is determined to be within current limits established above in block 136, then the values of each parameter are saved in the EEPROM in block 138. If the orthosis device angle is not within the specified limits, and the UP key is depressed which causes motion to the closest limit at block 137.

As discussed above, if the orthosis device is within the specified limits, then the motion can be initiated by depressing the go/stop button 36 at block 140. If the go/stop button is not depressed, the processor returns to the beginning of the MAIN module.

If the run/go mode is selected, the processor enters the MSTART function of the TACHT1 module at block 142.

Figure 9:
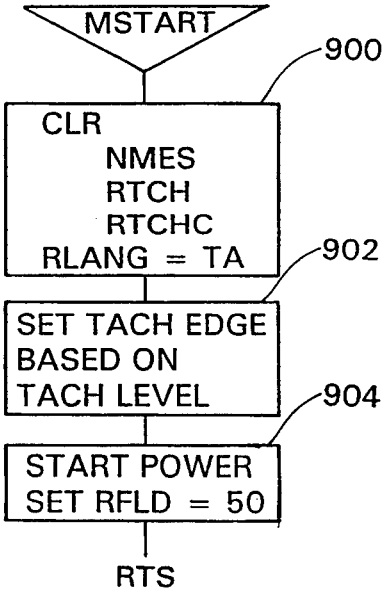

The TACHT1 module is responsible for motor speed control. Referring specifically to FIG. 9, the MSTART function is responsible for motor start-up which performs a number of different functions including clearing motor related faults, clearing total tachometer counts and setting the last tested orthosis angle to the current orthosis angle. The tachometer interrupt edge is determined by tachometer line level.

The TACHT1 module as discussed above, performs motor speed control using the motor tachometer and T1 timer for power pulse width control. The tachometer provides 15 symmetrical pulses per motor revolution. The tachometer generates external interrupt 2 which is enabled on high priority once the motor is started. The interrupt edge polarity is dependent on the tachometer line level just prior to the power pulse. This assures that the ON pulses cause at least one 1/30 rotor rotation (0.5 to 1 tachometer pulse width). The tachometer pulses are also counted during the power OFF period to determine the amount of motor coast. If motor power is ON during tachometer interrupt, the ON time period is stopped, angle, voltage and current measurements are taken, the power is turned OFF, the ON time is recorded/and previously calculated OFF period timers (T1C2) are started. If the first limit delay is set, it is counted down. Each tachometer pulse is also totalled for angle change versus tachometer motion monitoring.

Timer 1 provides motor power on limit monitoring (T1C1), power ON pulse width timing (T1) and ON/-OFF pulse width timeout (T1C2). Timer 1 is set to 85 microseconds resolution and enabled on high priority interrupts while the motor is running. When the timer 1 reaches C1 or C2 value, an interrupt is generated. If C1 is reached and motor power is ON, then no tachometer pulse has occurred during the maximum power ON period, which causes conversion, power OFF and an indication of the tachometer fault. If C2 is reached (end of motor power OFF period), the-new OFF period is calculated based on the set speed period counts the number of tachometer coast pulses divided by the angle assuming that the orthosis device is an indirect drive type. Division by angle is a first order approximation of the trigonometric motor speed to angular speed relationship for indirect drives.

Figure 12A:
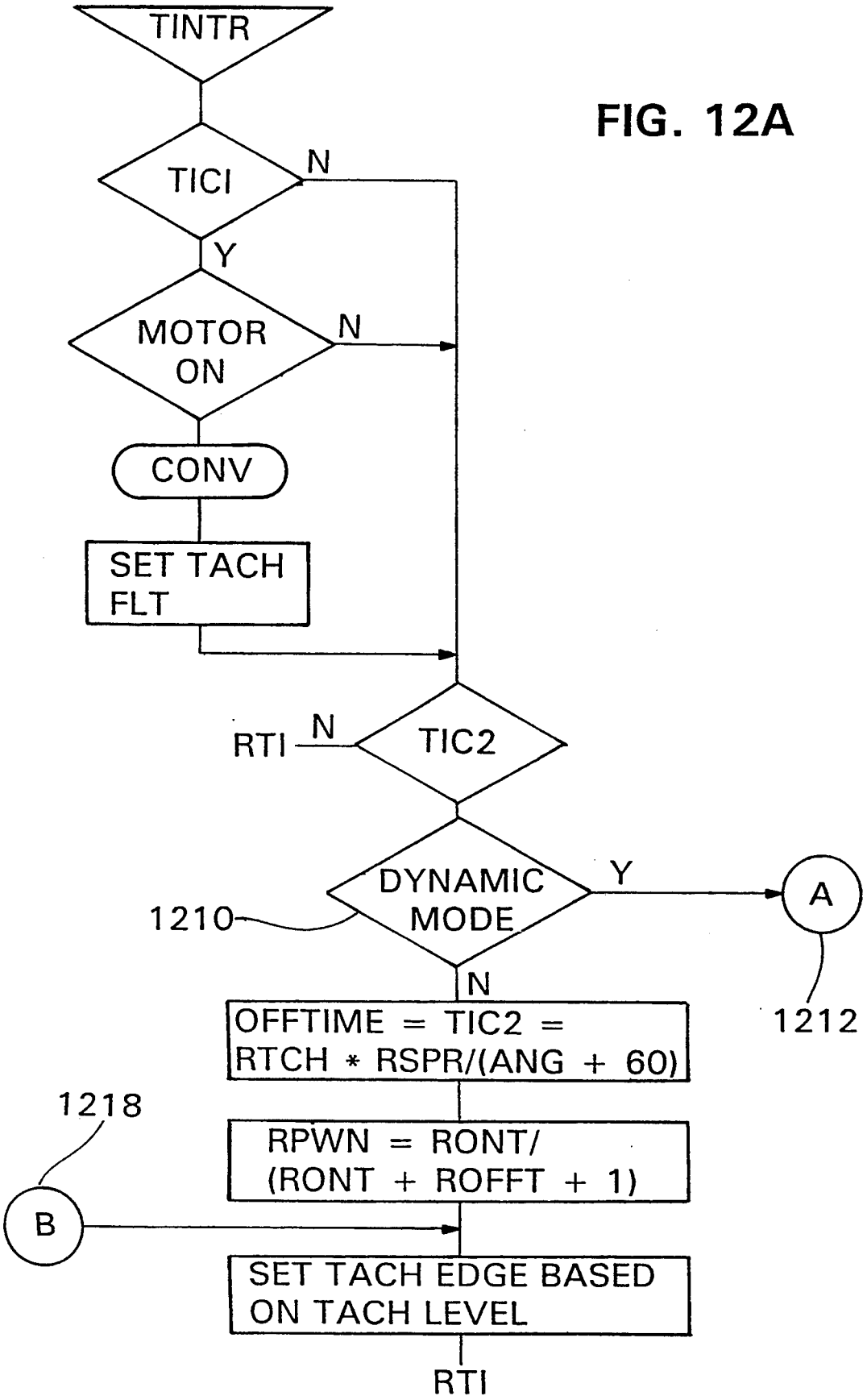
Figure 12B:
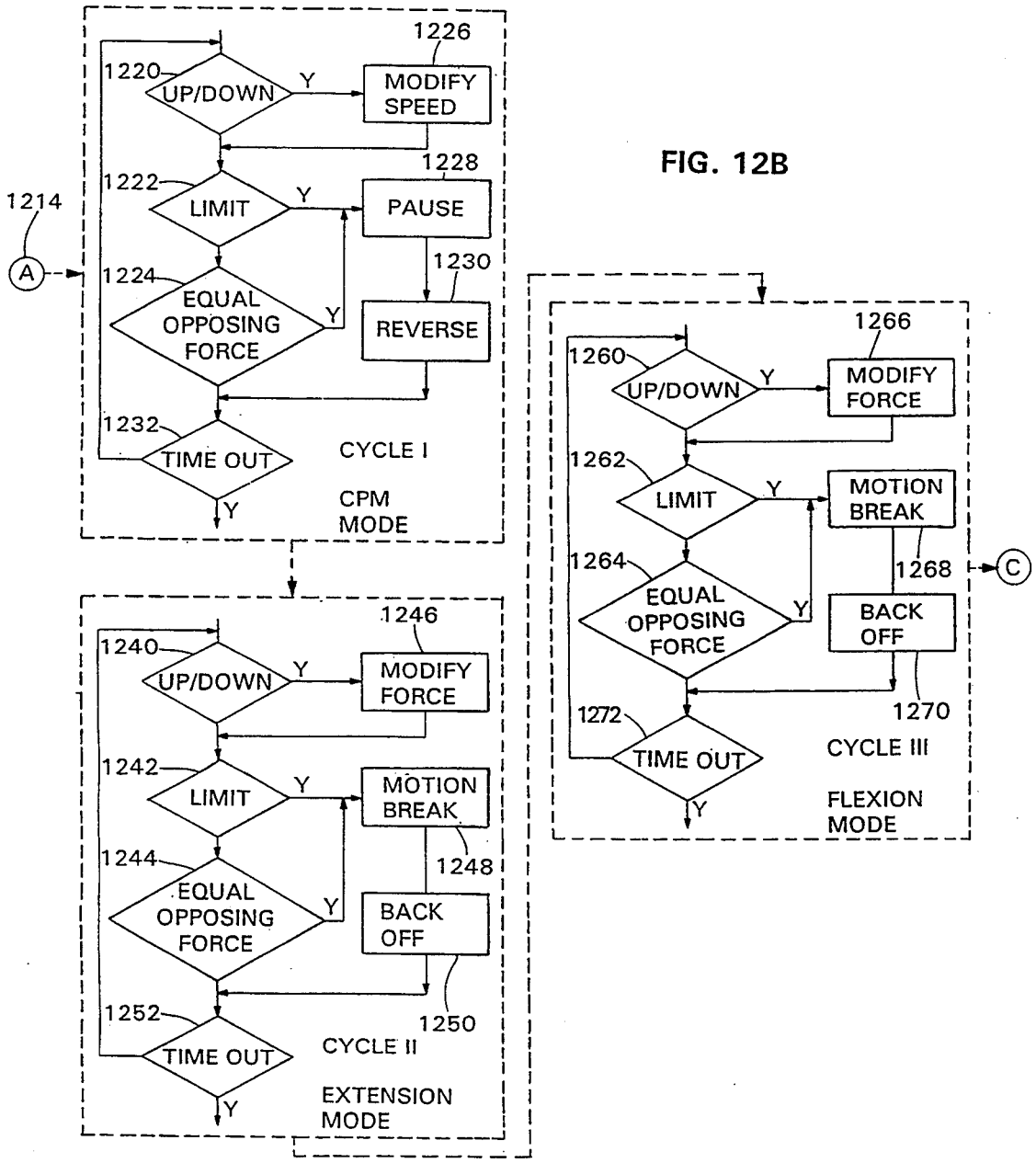

Referring specifically to FIGS. 12A,B, a determination is made block 1210 whether the dynamic tension mode has been requested using the controller **10*b*. In the dynamic tension mode of CPM operation a continuous constant force is applied to the joint under treatment in order to extend the range of motion of the joint. If this mode has been selected execution proceeds by way of off-page connector 1212 to on-page connector 1214. Execution later returns from the dynamic tension mode by way of off-page connector 1216 and on-page connector 1218**.

In the dynamic tension mode of treatment the joint may be initially loosened up with continuous motion. The continuous motion is provided under constant force control for a predetermined period of time or until an equal opposing force is encountered. This may be referred to as the first dynamic tension cycle or as the dynamic tension CPM cycle. Then a constant force may be applied in one direction on the joint, with any joint motion occurring only as the result of the applied force. This constant force is applied for another predetermined time period or until limit is reached. This may be referred to as the second dynamic tension cycle or as the dynamic tension extension cycle. Then a constant force may be applied in the opposite direction on the joint for another predetermined time period. This may be referred to as the third dynamic tension cycle or as the dynamic tension flexion cycle. The first cycle is then repeated and followed by the two tensioning cycles.

This sequence of motion and tensioning minimizes patient fatigue. During tensioning, the joint position is automatically adjusted, up or down, to maintain the set force. Any of the three dynamic tension cycles can be skipped b setting its corresponding time period to zero. Also, the range of motion limits control the final range of tensioning and motion. A program, understandable to those skilled in the art, effective to perform the functions set forth herein as part of the dynamic tension mode, is attached as an appendix.

Extension and flexion limits may be entered into the controller **10*b* in the manner previously described in order to control the final range of motion limits in the dynamic tension mode. The period of the extension tensioning is selected using the previous/next parameter selection input keys 41, 43 and set in hours and minutes using the up/down input keys 32, 34. The period of flexion and tensioning is also selected in hours and minutes as well as the extension and flexion tensioning force and the motion time period as previously described. Prior to attaching the orthosis to the patient, the orthosis is set to half of the limit set range of motion, using the UP key 32. After attachment of the orthosis, the dynamic tension mode is started by depressing the go/stop key 36. The controller 10*b*** displays "DT CPM" the time remaining in the current cycle in minutes, and the total accumulated time in hours and minutes. The orthosis moves in one direction at a predetermined speed until either the opposing force, equal to the set force, causes the speed to drop to some predetermined minimum speed, or the set limit is reached.

When the speed drops to the predetermined minimum or the set limit is reached, the direction of motion is reversed as shown in blocks 1224, 1228, 1230. This cycle continues until the DT CPM period expires as shown in block 1232. Then the display 40 changes to "DT ext" and indicates the extension time period. Motion is set for the extension direction and continues until stopped by an opposing force equal to the extension force as shown in block 1244 or until the extension limit is reached as shown in block 1242. After pausing for a few seconds with a set motion break as shown in block 1248, motion is reversed for a fraction of a second as shown in block 1250, and again reversed to the extension direction until it is stopped by an opposing force. This momentary reversal permits position back off, if necessary, to maintain the set force.

This extension tensioning cycle continues in the dynamic tension mode until the dynamic tension extension time period expires as shown in block 1252 or until the extension limit is achieved. Then the display 40 changes to "DT Flx" to indicate the dynamic tension flexion cycle. The flexion time period is also displayed. The motion reverses and the orthosis device moves in the flexion direction until it is stopped by an opposing force equal to the set flexion force as shown in block 1264. This flexion tensioning cycle continues until the dynamic tension flexion time period expires as-° shown in block 1272 or until the flexion limit is achieved as shown in block 1262. The DT CPM cycle may then be restarted.

During the DT CPM cycle, the up key 32 and the down key 34 may be used to modify the speed of the orthosis as shown in blocks 1220, 1226. During the dynamic tension extension the up/down keys 32, 34 may be used to modify the extension force as shown in blocks 1240, 1246. And during the dynamic tension flexion cycle, the up key 32 and the down key 34 change the flexion force as shown in blocks 1260, 1266. Motion and tensioning can be stopped at any time by depressing the go/stop key 36. They may be resumed by a second depression of the go/stop key 36. When the orthosis is stopped, the display 40 shows "DT STOP", and the orthosis moves to half the set range of motion limits. In the DT CPM cycle, motion resumes in the opposite direction. If power is turned off while "DT STOP" is displayed the unit restarts at the start of DT CPM mode with the "Push Go to Start" message when power is resumed.

In the constant speed CPM operation CPM speed is based on the CPM motor speed constant which specifies the motor revolutions per minute per volt of the applied EMF voltage or the back EMF voltage. Constant speed is maintained by maintaining constant back EMF voltage. In the dynamic tension mode constant force operation, CPM force is based on the CPM motor torque constant which specifies the motor torque per ampere of current flowing through the motor. Constant force is maintained by maintaining constant motor current.

When using pulse width modulation the average motor power is controlled by controlling the ratio of the power-on pulse to the total period. The total period is determined as power-on pulse time plus power-off pulse time. In dynamic tension mode the set speed is the CPM speed under no load. The set force is then applied force when the speed is zero. The speed-force curve is based on the average applied motor power as set by the requested force and speed. The CPM software controls the power-off period and, therefore, the average power by computing the average current of equation (5):

$$I_{AVG}=F_{set}*F_c-V_{emf}/(S_{set}*S_c)+I_{nt} \quad (5)$$

where $I_{AVG}$ is the required average current, $F_{set}$ is the set force, $F_c$ is the force conversion constant, $V_{emf}$ is the measured back EMF (current speed), $S_{set}$ is the set speed, $S_c$ is the speed conversion constant representative of the gear ratio and the rpm/volt of the motor, and $I_{nt}$ is the no load current or idle current.

Additionally, the CPM software controls the motor power-off period according to equation (6):

$$T_{off}=T_{on}*(I_{mas}-I_{avg})/I_{avg} \quad (6)$$

where $T_{off}$ is the computed power-off period of a pulse, $T_{on}$ is the power-on period, $I_{mas}$ is the measured current when the motor is on during the $T_{on}$ period, and $I_{avg}$ is the required average current as determined by equation (5).

The dynamic tension feature of the present invention is implemented in the MAIN module by controlling the sequence of events and in MOTOR module by computing and controlling motor power by the variable period of the motor off time. In MAIN, at line 229 of the program of the attached appendix, based upon parameter SQSF a determination is made which mode to implement. For example, the warm up mode or dynamic tension mode may be selected at this point. If the selected program, as indicated by the value in RPRG, is the warm up mode feature, then normal WarmUp/Run program is implemented. Otherwise the dynamic tension mode is started at SQBF, at line 369 of the appendix. SQBF starts the DT CPM cycle and SSQB maintains the cycle until the orthosis stops due to a force stall, the range of motion limit is reached, or the DT CPM period is expired.

If the orthosis stops, execution transfers to SQES. If there is a force stall the motor direction is reversed at SQBF and the parameters are stored. If the appropriate limit is reached, as determined at SQBL and SQBP, then SQBF reverses direction. If the time period expires, SQCS starts the dynamic tension extension cycle. SSQC maintains the cycle until the orthosis stops, the range of motion limit is reached, or the dynamic tension extension period expires. If there is a stop, execution transfers to SQES. If the limit is achieved or the period expires, SQDS starts the dynamic tension flexion cycle.

SSQD maintains the cycle in similar manner. At the end of SSQD execution returns to SQBS. The DT STOP cycle at SQES saves the previous sequence in SRSQ, sets the range of motion limits to one-half of their specified value, and determines whether the current position is within limit. If it is within limit, SQEX resets the GO flag and saves parameters. If it is not within limit, the direction is set for motion toward a limit at SQET through SQEF. When a Go signal is received the previous cycle is restarted by SQER. The saved sequence and the restart table SQDTT are used in this restarted sequence.

The common functions of the dynamic tension mode are performed at line 682 of the appendix. SQDT line 756 of the appendix calculates orthosis table pointers and the power on restart. SQDO performs one second timing and at odd minute marks saves parameters. SQD1 controls roll-over of hours. SQD2, SQD3, DQD4 perform timing calculations for various dynamic tension time periods. SQEU, SQED, SQFU, SQFD provide force modification in the respective cycles of the dynamic tension mode. SQSU and SQSD, line 767, column UP and DN permit speed modification. SQEU, SQED, SQFU, SQFD permit extension and flexion force modification. Other columns in the SSQT table define GO/STOP actions.

The SSQT table defines action sequences for each cycle of the dynamic tension mode. Entries in this table permit examination of parameters with SQDA.

Once the motor has been started, the run/go mode can include one second timeout actions at block 144. The timeout actions are time dependent actions which time out other displays that overlay the run display, countdown of the pause display, the stepping of the minute counter and the updating of run time. Additionally, a determination is made whether the warm up option has been requested at block 147. If it has, the warm up timer is set.

If one second timeouts are not requested, the processor enters the LIMTST module at block 148. The details of the LIMTST module are discussed above. Once the appropriate limits for each parameter have been set by the limit module, the run/go function performs a series of tests to determine whether any limits or any out-of-limit conditions have been reached and to determine whether a fault has occurred in blocks 150–156. These tests include force limits, angular limits and first limit delay, and unexpected stop or decrease in the speed of motion of the device and other various parameters.

The TIME functional module performs all real-time related timing functions with a resolution of 20 milliseconds. The time functions are based on timer 2 interrupts, enabled for low priority and counting continuously.

The main functions of the time module are the keypad scans, blink timing, stop/reverse timeout and 1 second flag set. The keypad 24 is scanned on each-entry. The current value is compared to the previous value for 20 milliseconds debounce. Only values that are the same for two or more consecutive scans are reported. The stop/go key 36 causes toggle action if control is in the run mode, and the set mode holds GO in the reset state. Blink time is based on toggling every 300 milliseconds the blink bit in the motor control register if the GO bit is set. Stop/reverse timeout comprises timing the stop period and restarting motion in reverse direction if the controller is not in the pause period. A 1 second flag is always set at a 1 second rate and the MAIN module is responsible for actions and resets.

The EEPRW module provides parameter restoration (PRMRST) and save (PRMSAV) capabilities. The parameters are saved and retrieved from the EEPROM memory and defined RAM registers. The PRMRST capability restores parameters by reading the content of the EEPROM at specific bank addresses and writing to the set RAM registers. A check sum assures data validity. If an error exists, a fault is set which requires parameter check. The PRMSAV capability write parameters from the RAM into EEPROM. Only changed data causes a write function to occur. Each write function is verified and a check sum is calculated and also saved. If the content of the written EEPROM does not verify, the bank address is incremented and data is rewritten to the next bank. Bank addresses are also saved in EEPROM and point to the last valid parameter bank.

THE DISPLAY module provides a collection of display subroutines and the LCD driver. When a specific subroutine is called up, the subroutine usually requires additional parameters that act as pointers (RMPT) or are actual values usually contained with in the A or B registers. Parameter specific display routines use the primitive subroutines to accomplish the full line display. The PRMDSP function determines the selected parameter (RDSP) and calls or branches to the appropriate parameters specific display routine. All subroutines perform normal call return after displaying the requested information.

To overwrite a displayed LCD line first RMPT is set to a message header or null text. A call on the DSPM resets display cursor to first character position and writes header and to a null character. The cursor is left in that position until each subsequent character overlays the character under the cursor and the cursor advances to the right. Character primitive routines write one or more characters to the display. The DSPS writes one space. The DSPC writes the ASCII character in the A register. The DSPNS and the DSPN write a hexadecimal or a number with leading zero suppression. The DSPBN converts the binary number in the B register to the ASCII decimal and displays the three characters with leading zero suppression.

The DSPANG displays the current orthosis angle. The DSPA displays the content of the B register as the angle. Angle display assumes logical angle is input and displays orthosis physical angle. The DSPFRC is the same as two digit numeric display. DSPPSE displays the contents of the A and B registers as minutes and seconds. The DSPTIM displays the content of RTIM assuming two-register BCD input. The DSPHST, DSPRUN and PRMDSP are high level line display subroutines that display current histogram, run time display and selected parameter display. The run time display (DSPRUN) determines the motion state. If the motion state is in pause, displays the pause timeout (RPTO) is pause display, otherwise the accumulated run time is displayed using DSPTIM. This is followed by extension limit and direction determination which causes appropriate limit angle, which indicates direction of motion to blink, followed by orthosis angle using DSPANG and finally the flexion limit.

The DSPHST selects the header point based on motion direction and sets the RPTO to the appropriate force profile histogram table. Each table consists of 15 bytes whose position determines a logical 16 degree segment. The content is in 0.4 watts power increments which is displayed as ASCII characters starting with zero and having a range of 80. Each segment is displayed as an alphanumeric character in ascending degree segment order. The PRMDSP determines the selected parameter by the content of the RDSP register, displays a parameter label and branches to appropriate parameter specific display. The DSPLAY module also contains the parameter text labels abbreviated to fit in the 16 character display with the parameter value.

From the foregoing description, it can be seen that the present invention comprises a universal CPM controller for controlling a plurality of types of CPM orthosis devices. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the scope and spirit of the invention as defined by the appended claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A universal controller system having a plurality of differing control algorithms for controlling a plurality of differing types of continuous passive motion (CPM) devices, comprising:

identifying means within a selected controlled CPM device having an individual type of said plurality of differing types of CPM devices for providing an identifying parameter representative of said individual type of said selected controlled CPM device;

control means for receiving said identifying parameter from said selected controlled device;

means for determining said individual type of said selected CPM device and a control algorithm of said plurality of control algorithms in response to said identifying parameter; and an actuator for actuating said selected CPM device in accordance with said determining.

2. The universal controller according to claim 1, further comprising means for applying dynamic tension.

3. The universal controller according to claim 2, wherein said applied dynamic tension comprises first and second dynamic tension cycles.

4. The universal controller according to claim 3, further comprising means for applying constant force during said first dynamic tension cycle.

5. The universal controller according to claim 3, further comprising means for moving at a constant force during said second dynamic tension cycle.

6. The universal controller according to claim 5, wherein said constant force provides an extension subcycle and a flexion subcycle to a joint of a person.

7. The universal controller according to claim 1, including means for loosening a joint of a person further comprising warm up means for gradually loosening said joint of said person.

8. The universal controller according to claim 1, wherein an articulating element of said CPM device has a predetermined first range of motion further comprising means for moving said articulating element over a second range of motion smaller than said first range of motion.

9. The universal controller according to claim 8, further comprising means for gradually extending said second range of motion to approach said first range of motion.

10. The universal controller according to claim 8, wherein said articulating element provides constant angular velocity to a joint of a person.

11. The universal controller according to claim 1, wherein said controller is provided with operating parameters further comprising a display for displaying said operating parameters.

12. The universal controller according to claim 11, further comprising means for applying an offset to said operating parameters prior to said displaying of said operating parameters.

13. The universal controller according to claim 12, wherein said offset is adjustably selected to provide a display value of zero when an element of said CPM device is disposed in a predetermined position.

14. The universal controller according to claim 12, wherein selection of said offset comprises calibration of said CPM device.

15. A continuous passive motion controller for controlling a continuous passive motion CPM device for providing motion to a joint of a person, comprising:

a motor for driving at least one articulated element of said CPM device, said motor being operatively connected to articulate said element about at least one pivot point; and motor speed adjustment means for adjusting the speed of the motor such that said articulated element pivots at a constant angular velocity around a predetermined pivot point, wherein said predetermined pivot point is in the vicinity of said joint.

16. The universal controller according to claim 15, further comprising means for applying dynamic tension.

17. The universal controller according to claim 16, wherein said applied dynamic tension comprises first and second dynamic tension cycles.

18. The universal controller according to claim 17, further comprising means for applying constant force during said first dynamic tension cycle.

19. The universal controller according to claim 17, further comprising means for moving at a constant force during said second dynamic tension cycle.

20. The universal controller according to claim 19, wherein said constant force provides an extension subcycle and a flexion subcycle to said joint.

21. The universal controller according to claim 15, including means for loosening said joint further comprising warm up means for gradually loosening said joint.

22. The universal controller according to claim 15, wherein an articulating element of said CPM device has a predetermined first range of motion further comprising means for moving said articulating element over a second range of motion smaller than said first range of motion.

23. The universal controller according to claim 22, further comprising means for gradually extending said second range of motion to approach said first range of motion.

24. The universal controller according to claim 22, wherein said articulating element provides constant angular velocity to said joint.

25. The universal controller according to claim 15, wherein said controller is provided with operating parameters further comprising a display for displaying said operating parameters.

26. The universal controller according to claim 25, further comprising means for applying an offset to said operating parameters prior to said displaying of said operating parameters.

27. The universal controller according to claim 26, wherein said offset is adjustably selected to provide a display value of zero when an element of said CPM device is disposed in a predetermined position.

28. The universal controller according to claim 26, wherein selection of said offset comprises calibration of said CPM device.

29. The universal according to of claim 15, wherein motion of said articulated element is induced by a constant force.

* * * * *